US007536134B2

(12) United States Patent
Oda et al.

(10) Patent No.: US 7,536,134 B2
(45) Date of Patent: May 19, 2009

(54) IMAGE HOLDING MEMBER AND IMAGE FORMING APPARATUS

(75) Inventors: Yasuhiro Oda, Ebina (JP); Katsumi Nukada, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 380 days.

(21) Appl. No.: 11/598,045

(22) Filed: Nov. 13, 2006

(65) Prior Publication Data

US 2007/0292181 A1 Dec. 20, 2007

(30) Foreign Application Priority Data

Jun. 14, 2006 (JP) ..... 2006-164423

(51) Int. Cl.
*G03G 15/00* (2006.01)

(52) U.S. Cl. ..... 399/159; 399/116

(58) Field of Classification Search ..... 399/116, 399/159, 302, 308; 430/31, 58.05, 58.1
See application file for complete search history.

(56) References Cited

U.S. PATENT DOCUMENTS

| | | | | |
|---|---|---|---|---|
| 5,130,752 | A | 7/1992 | Morishita et al. | 355/274 |
| 5,139,912 | A * | 8/1992 | Aizawa | 430/67 |
| 5,753,396 | A * | 5/1998 | Nakamura et al. | 430/101 |
| 5,826,142 | A | 10/1998 | Takahashi et al. | |
| 5,908,724 | A * | 6/1999 | Matsui | 430/58.05 |
| 5,983,060 | A | 11/1999 | Namekata et al. | 399/297 |
| 6,278,858 | B1 * | 8/2001 | Nakazawa et al. | 399/302 |
| 6,341,205 | B1 * | 1/2002 | Yoshino et al. | 399/101 |
| 6,535,710 | B2 * | 3/2003 | Takeshima et al. | 399/279 |
| 7,142,801 | B2 * | 11/2006 | Kitani et al. | 399/302 |
| 7,251,437 | B2 * | 7/2007 | Tamoto et al. | 399/159 |
| 2003/0123910 | A1 | 7/2003 | Kim et al. | 399/296 |
| 2004/0018024 | A1 | 1/2004 | Lee | 399/38 |

FOREIGN PATENT DOCUMENTS

| | | |
|---|---|---|
| JP | A-2-157145 | 6/1990 |
| JP | A-8-176293 | 7/1996 |
| JP | A-8-208820 | 8/1996 |
| JP | A-9-251265 | 9/1997 |

* cited by examiner

*Primary Examiner*—Hoan H Tran
(74) *Attorney, Agent, or Firm*—Morgan, Lewis & Bockius LLP

(57) ABSTRACT

The invention provides an image holding member including at least a surface that has, after a predetermined discharge stress that is conditioned so that a sine-wave alternating-current bias of a peak-to-peak bias having 1.5 KV and a frequency 8 time S (Hz) is applied to the surface of the image holding member that is in a driving state where the movement speed of the surface is S (mm/s) is applied, a contact angle of water of at least about 70 degrees at a temperature of 22° C. and a relative humidity (RH) of 55%. The invention further provides an image forming apparatus including the image holding member, a charging device, a latent image forming device, a developing device, and a transfer device.

19 Claims, 4 Drawing Sheets

IMAGE HOLDING MEMBER AND IMAGE FORMING APPARATUS

BACKGROUND

1. Technical Field

The present invention relates to an image holding member and an image forming apparatus, and more particularly, to an image holding member mounted in an image forming apparatus using an electrophotography and an image forming apparatus including the image holding member.

2. Related Art

Conventionally know for image forming apparatuses are electrophotographic image forming apparatuses. In such an electrophotographic image forming apparatus, the surface (outer circumferential surface) of an image holding member such as a photosensitive drum is charged, an electrostatic latent image according to image data is formed on the charged image holding member, and the electrostatic latent image is made visable by developing the electrostatic latent image by a toner, thereby forming a toner image on the image holding member. The toner image formed on the image holding member is directly transferred to a recording medium by transferring means or transferred to a recording medium through an intermediate transferring body and fixed onto the recording medium, thereby forming an image on the recording medium.

In such an image forming apparatus, in order to remove adhering impurities such as a toner which is not transferred on the recording medium or the intermediate transferring body and is left on the image holding member, a cleaning blade such as a cleaning blade is provided and the foreign material on the image holding member is scraped off and removed by the cleaning blade. However, when a method for scraping and removing the foreign material on the image holding member is used, the surface of the image holding member is worn by friction between the cleaning blade and the image holding member and thus the life span of the image holding member is shortened.

SUMMARY

According to an aspect of the invention, there is provided an image holding member including at least a surface that has, after a predetermined discharge stress that is conditioned so that a sine-wave alternating-current bias of a peak-to-peak bias having 1.5 KV and a frequency 8 time S (Hz) is applied to the surface of the image holding member that is in a driving state where the movement speed of the surface is S (mm/s) is applied, a contact angle of water of at least about 70 degrees at a temperature of 22° C. and a relative humidity (RH) of 55%.

DETAILED DESCRIPTION

Hereinafter, an embodiment of the invention will be described with reference to the attached drawings.

Figure 1:
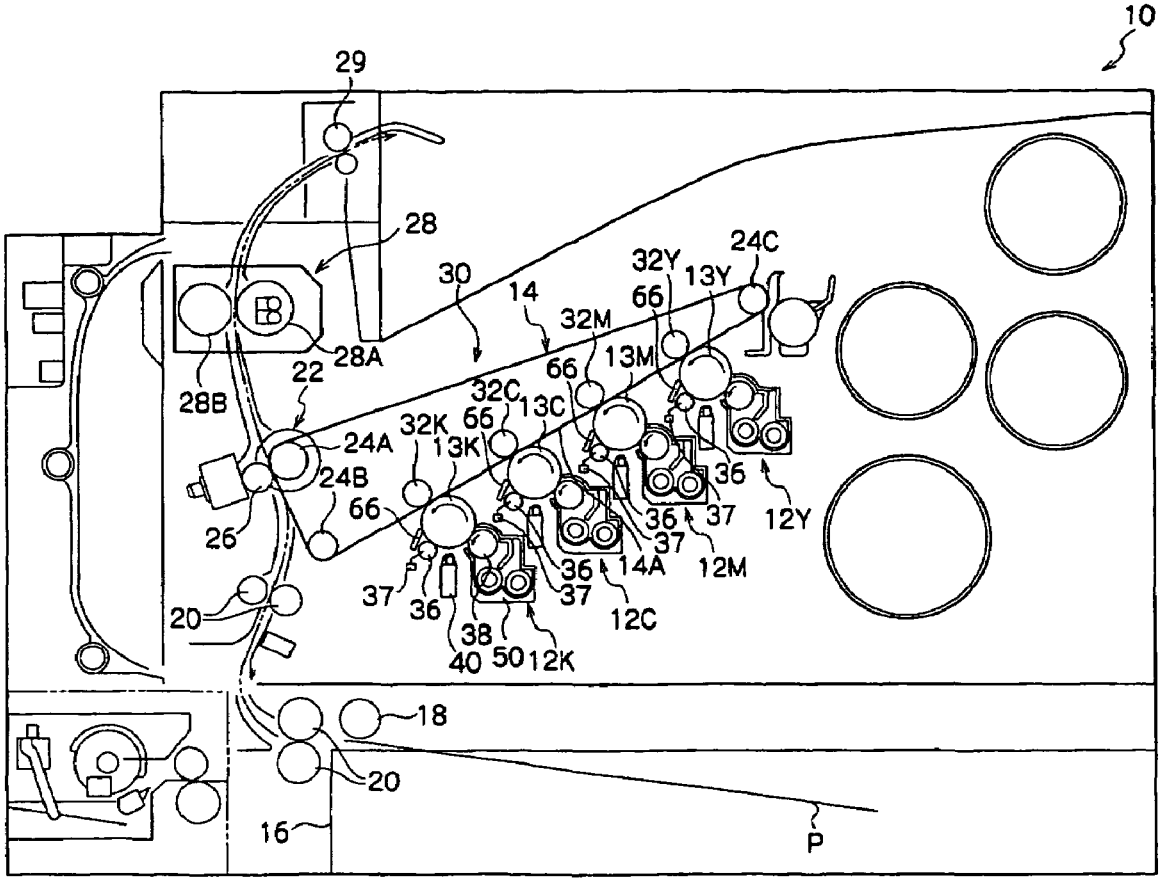
FIG. 1 is a schematic diagram showing the configuration of an image forming apparatus according to the present embodiment.

As shown in FIG. 1, an image forming apparatus 10 according to an exemplary embodiment of the invention is a so-called tandem type full-color laser printer in which a developing unit 12Y, a developing unit 12M, a developing unit 12C and a developing unit 12K of yellow, magenta, cyan and black, and an image holding member 13Y, an image holding member 13M, an image holding member 13C and an image holding member 13K as an image holding member, are arranged parallel to an intermediate transfer belt 14 interposed therebetween, and the intermediate transfer belt 14 overlaps four toner images during one cycle.

The image forming apparatus 10 includes a feeding tray 16 at the bottom. A feeding roll 18 is in contact with the front edge of a carrying direction of a sheet of paper P set in the feeding tray 16 and the sheet P is fed from the feeding tray 16 to a downstream side of a sheet carrying direction of the feeding roll 18 by the feeding roll 18 and unillustrated single-sheet processing means. A pair of carrying rolls 20 is arranged at the downstream side of the sheet carrying direction of the feeding roll 18. The sheet P fed from the feeding tray 16 to the downstream side of the sheet carrying direction of the feeding roll 18 is carried to a transfer unit 22 by the pair of carrying rolls 20.

The transfer unit 22 includes a belt carrying roll 24A on which an intermediate transfer belt 14A is wound and a transfer roll 26 which is closely in contact with the belt carrying roll 24A. The intermediate transfer belt 14 is interposed at a facing portion between the belt carrying roll 24A and the transfer roll 26 and a toner image is transferred from the intermediate transfer belt 14 to the sheet P when passing through the facing portion.

A fixing unit 28 is provided above the transfer unit 22 and at the downstream side of the carrying direction of the sheet P. The fixing unit 28 includes a heat roll 28A and a backup roll 28B which is closely in contact with the heat roll 28A. The sheet P is carried between the heat roll 28A and the backup roll 28B such that each of the toners for configuring the toner image transferred to the sheet P is fused and solidified to be fixed to the sheet P. The sheet P on which the toner image is ejected to the outside of the image forming apparatus 10 by a sheet ejecting roll 29.

Next, a print unit 30 in which the image holding member 13Y, the image holding member 13M, the image holding member 13C and the image holding member 13K overlap the toner image on the intermediate transfer belt 14 will be described. When the colors such as yellow, magenta, cyan and black need be distinguished, reference numerals are attached with Y, M, C and K, but, when the colors need not be distinguished, Y, M, C and K attached to the reference numerals are omitted.

The intermediate transfer belt 14 is wound on the belt carrying roll 24A, a driving roll 24B provided below the belt carrying roll 24A, and a belt carrying roll 24C provided at an obliquely upward side of the driving roll 24B and on the opposite side of a sheet carrying path.

A surface which faces an obliquely downward side between the driving roll 24B and the belt carrying roll 24C of the intermediate transfer belt 14 becomes a transfer surface 14A on which the toner image is transferred from the image-bearing bodies 13Y, 13M, 13C and 13K. The developing unit 12Y, the developing unit 12M, the developing unit 12C and the developing unit 12K and the image holding member 13Y, the image holding member 13M, the image holding member 13C and the image holding member 13K are arranged in parallel to one another to face the transfer surface 14A. The image holding member 13Y, the image holding member 13M, the image holding member 13C and the image holding member 13K are in contact with the transfer surface 14A. A transfer roll 32Y, a transfer roll 32M, a transfer roll 32C and a transfer roll 32K are closely in contact with the image holding member 13Y, the image holding member 13M, the image holding member 13C and the image holding member 13K through the transfer surface 14A.

A charging roll 36, a voltage applying unit 37 for applying a voltage to the charging roll 36, a latent image forming device 40, a developing roll 38 provided in a developing unit 12, the transfer roll 32 and a cleaning blade 66 for removing adhering impurities on the image holding member 13 from the surface of the image holding member 13 are arranged on the outer circumferential surface of the image holding member 13 in sequence in a rotation direction of the image holding member 13.

The image forming apparatus according to an exemplary embodiment of the invention corresponds to the image forming apparatus 10, the image holding member of the image forming apparatus according to an exemplary embodiment of the invention corresponds to the image holding member 13, charging device corresponds to the charging roll 36, and voltage applying device corresponds to the voltage applying unit 37. In addition, latent image forming device of the image forming apparatus according to an exemplary embodiment of the invention corresponds to the latent image forming device 40, developing device corresponds to the developing unit 12, transfer device corresponds to the transfer roll 32, and cleaning device corresponds to the cleaning blade 66.

In the image forming apparatus 10 according to an exemplary embodiment of the invention, a contact angle between the surface of the image holding member 13 and pure water at 22° C. and 55% RH after a predetermined discharge stress is applied to the surface of the image holding member is at least 70 degrees.

Figure 4:
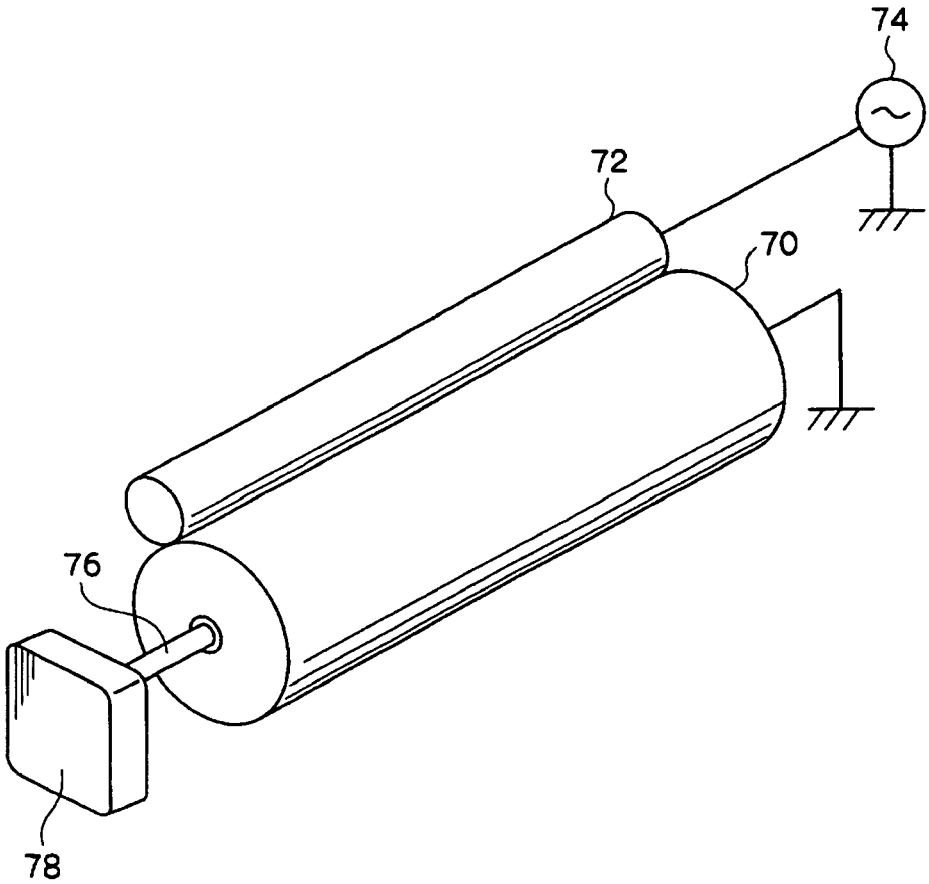
FIG. 4 is a schematic diagram showing the configuration of an apparatus for applying discharge stress.

In the "predetermined discharge stress", as shown in FIG. 4, an image holding member 70 as the image holding member 13 is connected to a motor 78 through a support member 76 provided on the rotational center of the image holding member 70 and rotated at conditions of a movement speed S (mm/s) of the surface of the image holding member 70 by driving the motor 78. In a driving state where the movement speed of the surface of the image holding member 13 is S (mm/s), applying a sine-wave alternating-current bias of a peak-to-peak bias having 1.5 KV and a frequency 8 time S (Hz) by a voltage applying mechanism 74 to a cylindrical charging roll 72 (corresponding to the charging roll 36) which is in contact with the outer circumferential surface of the image holding member 13 for a period of 200×L/S (sec.) is called the "predetermined discharge stress".

Here, L denotes a circumferential length (mm) of the image holding member 70. The charging roll 72 is in contact with the image holding member 70 and rotated by rotation of the image holding member 70. In addition, the charging roll 72 has a diameter of 8 mm to 16 mm and a common logarithm (LogR) of a volume resistance (Ω.m) of 7.0 to 8.5. The diameter of the image holding member 70 used in an experiment is preferably in a range of 30 mm to 60 mm.

The contact angle can be measured using goniometer. In the invention, after the discharge stress was applied, a droplet of pure water having a diameter of about 1.5 mm dripped onto the surface of the image holding member 13 in an environment of 22° C. 55% RH, and the contact angle of a droplet was measured after 10 seconds.

An average value of three measurement values which are obtained by performing measurement three times while changing a measurement place is taken as the contact angle between the surface (outer circumferential surface) of the image holding member 13 and the pure surface.

Figure 3:
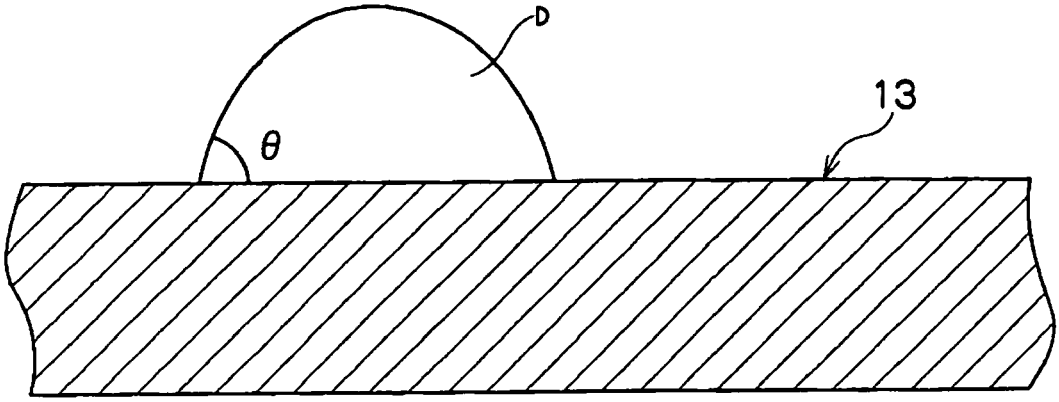
FIG. 3 is a schematic view illustrating a method for measuring a contact angle of pure water dropped on the surface of an image holding member.

For the method for measuring the contact angle of the droplet, as shown in FIG. 3, a droplet (shown as "D" in FIG. 3) which drops on the image holding member 13 may be photographed using an optical microscope and the contact angle θ may be obtained from the photography.

In the image holding member 13 of the image forming apparatus 10 according to an exemplary embodiment of the invention, since the contact angle for pure water in the environment of 22° C. and 55% RH is at least 70 degrees after the discharge stress is applied, it is possible to suppress products formed by electric discharge or moisture in air from being adhered to the surface of the image holding member 13.

Even when the products formed by electric discharge or moisture in air are adhered, since the contact angle for pure water of the image holding member 13 is at least 70 degrees, the surface energy of the surface of the image holding member 13 is low and release property of the products formed by electric discharge adhered to the image holding member 13 is high. Thus, the products formed by electric discharge on the image holding member 13 remain only with difficulty. Accordingly, it is possible to easily remove the products formed by electric discharge from the surface of the image holding member 13 by the cleaning blade 66.

Therefore, it is possible to provide the image forming apparatus 10 which is capable of suppressing the products formed by electric discharge from being adhered to the surface of the image holding member 13.

The contact angle between the surface of the image holding member 13 and the pure water in the environment of 22° C. 55% RH after the discharge stress is applied is at least about 70 degrees, more preferably at least about 75 degrees, and most preferably at least about 80 degrees.

When the contact angle is less than 70 degrees, the adhesion force of the products formed by electric discharge to a photosensitive body increases and thus image deletion may occur.

In addition, while an upper limit value of the contact angle between the image holding member 13 and the pure water under the above condition is not specially limited, it is preferably large. The upper limit value of the contact angle is, in practice, preferably up to 110 degrees due to limitations in properties of materials used for forming a surface layer of the image holding member and choices of the material.

The image holding member 13 of the invention is explained hereinafter in detail.

Conventionally-known photoreceptors such as an organic photoreceptor or inorganic photoreceptors such as an amorphous silicon photoreceptor or a selenium photoreceptor can be used as the image holding member 13 that corresponds to the image holding member of the image forming apparatus of the invention. Among these, organic photoreceptors, which are excellent and advantageous in the cost, the productivity, and disposal property, are preferably used in the invention.

While the organic photoreceptor is not particularly limited as long as it has at least a conductive substrate and a photosensitive layer provided on the conductive substrate, and in this invention, an organic photoreceptor having a function separation type photosensitive layer composed of a conductive substrate, a charge-generating layer and a charge-transporting layer, which are laminated in this order, is preferable in the invention in view of exhibition of the effect of the cleaning capability. Further, a surface protection layer is necessarily formed on the surface of the photosensitive layer. Further, in accordance with necessity, an intermediate layer may be formed between the photosensitive layer and the conductive substrate or between the photosensitive layer and the surface protection layer.

Examples of the conductive substrate may include a metal drum of such as aluminum, copper, iron, a stainless steel, zinc, or nickel; those obtained by depositing a metals such as aluminum, copper, gold, silver, platinum, palladium titanium, nickel-chromium, a stainless steel, copper-indium or the like on a base material such as a sheet, paper, plastic, glass or the like; those obtained by depositing conductive metal compounds such as indium oxide, tin oxide or the like on the above-mentioned base material; those obtained by laminating a metal foil on the above-mentioned base material; and those obtained by dispersing carbon black, indium oxide, tin oxide-antimony oxide powder, a metal powder or copper iodide in binder resins and applying the mixtures to the above-mentioned base material. The shape of the conductive substrate may be any one of drum-like, sheet-like, and plate-like shape.

Further, in the case where a pipe substrate made of metal is used as the conductive substrate, the surface of the pipe substrate made of metal may be as it is or the substrate surface may previously be subjected to surface roughening treatment. Such surface roughening can prevent wood grain pattern-like concentration unevenness which may be caused in the inside of the photoreceptor owing to coherent light in the case where coherent light source such as laser beam is used as an exposure light source. Examples of the surface treatment method include specular cutting, etching, anodization, rough cutting, center-less grinding, sand blast, wet horning and the like.

Specially, examples of the conductive substrate which are preferable in terms of improvements in adhesion to the photosensitive layer and in film formability include an aluminum substrate whose surface is anodized.

The charge-generating layer is formed by depositing a charge generating material by a vacuum evaporation method or applying a liquid containing a charge generating material, an organic solvent and a binder resin.

Examples of the charge generating material include selenium compounds such as amorphous selenium, crystalline selenium, selenium-tellurium alloy, selenium-arsenic alloy, or other selenium compound; inorganic photoconductors such as selenium alloy, zinc oxide, or titanium oxide; those obtained by dye-sensitizing them; various kinds of phthalocyanine compounds such as metal-free phthalocyanine, titanyl phthalocyanine, copper phthalocyanine, tin phthalocyanine, or gallium phthalocyanine; various kinds of organic pigments such as squarylium, anthoanthrone, perylene, azo, anthraquinone, pyrene, pyrylium salts, or thiapyrylium salts; and dyes.

These organic pigments generally have several types of crystal structures, and particularly, various crystal types such as α-type crystal structure or β-type crystal structure have been known for phthalocyanine compounds. Any crystal structure can be employed as long as they are pigments providing sensitivity and other properties which accord to objects thereof.

Among these charge generating material, a phthalocyanine compound is preferable. In this case, when light is irradiated to the photosensitive layer, the phthalocyanine compound contained in the photosensitive layer absorbs photon and generates a carrier. At that time, since the phthalocyanine compound has a high quantum efficiency, the compound can efficiently absorb the photon and generate the carrier.

Examples of the binder resin to be used for the charge-generating layer include: polycarbonate resins such as bisphenol A resins or bisphenol Z and copolymers thereof, polyarylate resins, polyester resins, methacrylic resins, acrylic resins, poly(vinyl chloride) resins, polystyrene resins, poly(vinyl acetate) resins, styrene-butadiene copolymer resins, vinylidene chloride-acrylonitrile copolymer resins, vinyl chloride-vinyl acetate-maleic anhydride resins, silicone resins, silicon-alkyd resins, phenol-formaldehyde resins, styrene-alkyd resins, and poly(N-vinylcarbazole) and the like.

These binder resins may be used alone or two or more of them by mixing thereof. The mixing ratio of the charge generating material and the binder resin (charge generating material: binder resin) is preferably in a range of approximately 10:1 to 1:10 by weight. The thickness of the charge-generating layer is, in general, preferably in a range of approximately 0.01 to 5 μm and more preferably in a range of approximately 0.05 to 2.0 μm.

The charge-generating layer may contain at least one kind of electron acceptor substances in view of improving sensitivity and reducing the residual potential and the fatigue in the case of repeated use. Examples of the electron acceptor substance used for the charge-generating layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorene, picric acid, o-nitrobenzoic acid, p-nitrobenzoic acid, phthalic acid and the like. Among them, fluorenone compounds, quinone compounds, and benzene compounds having electron attractive substituent groups such as Cl, CN, $NO_2$ or the like are especially preferable.

Examples of a method for dispersing the charge generating material in the resin include methods using a roll mill, a ball mill, a vibration ball mill, an attriter, a Dyno-mill, a sand mill, or a colloid mill and the like.

Examples of a solvent of a coating liquid for forming the charge-generating layer include conventionally-known organic solvents such as aromatic hydrocarbon solvents such as toluene, chlorobenzene or the like; aliphatic alcohol solvents such as methanol, ethanol, n-propanol, iso-propanol or n-butanol; ketone solvents such as acetone, cyclohexanone or 2-butanone; halogenated aliphatic hydrocarbon solvents such as methylene chloride, chloroform or ethylene chloride; cyclic- or straight chain-ether solvents such as tetrahydrofuran, dioxane, ethylene glycol, diethyl ether; and ester solvents such as methyl acetate, ethyl acetate or n-butyl acetate.

Any one of charge-transporting layers formed by conventionally-known methods can be used as the charge-transporting layer in the invention. The charge-transporting layer may be formed by using a charge transporting material and a binder resin or by using a polymer charge transporting material.

Examples of the charge transporting material may include electron transporting compounds such as: quinone compounds such as p-benzoquinone, chloranil, bromanil, or anthraquinone; tetracyanoquinodimethane compounds; fluorenone compounds such as 2,4,7-trinitroflurenone; xanthone compounds; benzophenone compounds; cyanovinyl compounds; or ethylene compounds, and electron hole transporting compounds such as: triarylamine compounds; benzidine compounds; arylalkane compounds; aryl-substituted ethylene compounds; stilbene compounds; anthracene compounds; or hydazone compounds.

While these charge transporting materials may be used alone or in form of a mixture of two or more of them, the materials are not limited to these. In terms of the mobility, materials represented by any one of the following Structural formulas (1) to (3), which may also be used alone or in form of a mixture of two or more of them, are preferably used in the invention.

Structural formula (1)

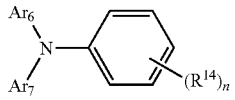

In Structural formula (1), $R^{14}$ denotes a hydrogen atom or a methyl group; n denotes 1 or 2; $Ar_6$ and $Ar_7$ independently denote an aryl group which may have a substituent, —C($R^{18}$)═C($R^{19}$)($R^{20}$) or —CH═CH—CH═C(Ar)$_2$ and the substituent is a halogen atom, an alkyl group having 1 to 5 carbon atoms, an alkoxy group having 1 to 5 carbon atoms, or a substituted amino group which has an alkyl having 1 to 3 carbon atoms as a substituent thereof.

Structural formula (2)

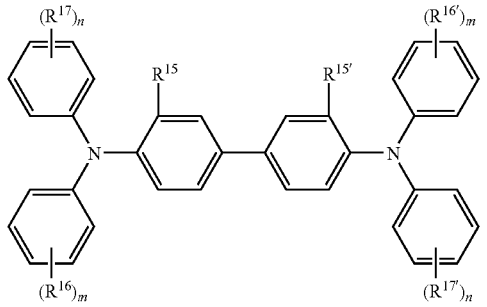

In Structural formula (2), $R^{15}$ and $R^{15'}$ may be same or different and independently denote a hydrogen atom, a halogen atom, an alkyl group having 1 to 5 carbon atoms, or an alkoxy group having 1 to 5 carbon atoms; $R^{16}$, $R^{16'}$, $R^{17}$, and $R^{17'}$ may be same or different and independently denote a hydrogen atom, a halogen atom, an alkyl group having 1 to 5 carbon atoms, an alkoxy group having 1 to 5 carbon atoms, a substituted amino group which has an alkyl having 1 or 2 carbon atoms as a substituent thereof., an aryl group which may have a substituent, —C($R^{18}$)═C($R^{19}$)($R^{20}$), or —CH═CH—CH═C(Ar)$_2$.

In Structural formulas (1) and (2), $R^{18}$, $R^{19}$, and $R^{20}$ independently denote a hydrogen atom, an alkyl group which may have a substituent, or an aryl group which may have a substituent; and m and n independently denote an integer of 0 to 2.

Structural formula (3)

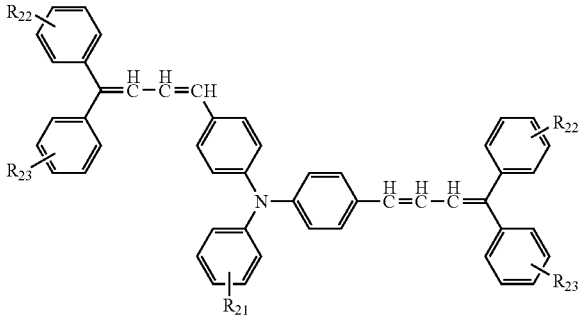

In Structural formula (3), $R^{21}$ denotes a hydrogen atom, an alkyl having 1 to 5 carbon atoms, an alkoxy group having 1 to 5 carbon atoms, an aryl group which may have a substituent, or —CH═CH—CH═C(Ar)$_2$; $R^{22}$ and $R^{23}$ may be same or different and independently denote a hydrogen atom, a halogen atom, an alkyl group having 1 to 5 carbon atoms, or an alkoxy group having 1 to 5 carbon atoms, an amino group having an alkyl group having 1 to 2 carbon atoms as a substituent thereof, or an aryl group which may have a substituent.

With respect to the substituent group in Structural formulas (1) to (3), Ar denotes an aryl group which may have a substituent.

Examples of the binder resin to be used for the charge-transporting layer further include polycarbonate resins, polyester resins, methacrylic resins, acrylic resins, poly (vinyl chloride) resins, poly(vinylidene chloride) resins, polystyrene resins, poly(vinyl acetate) resins, styrene-butadiene copolymers, vinylidene chloride-acrylonitrile copolymers, vinyl chloride-vinyl acetate copolymers, vinyl chloride-vinyl acetate-maleic anhydride copolymer, silicon resins, silicon-alkyd resins, phenol-formaldehyde resins, styrene-alkyd resins; polymer charge transporting materials such as poly (N-vinylcarbazole), polysilane, and polyester type polymer charge transporting materials described in JP-A Nos. 8-176293 and 8-208820. These binder resins may be used alone or in form of a mixture of two or more of them. The mixing ratio of the charge transporting material and the binder resin is preferably approximately 10:1 to 1:5 by weight.

The polymer charge transporting material may be used singly. Examples of the polymer charge transporting material include conventionally-known materials having charge transporting property such as poly(N-vinylcarbazole) or polysilane. Specially, polyester type polymer charge transporting materials shown in JP-A Nos. 8-176293 or 8-208820 have high charge transporting property and therefore particularly preferable. The polymer charge transporting materials may be used as they are for the charge-transporting layer and may be used in combination with the above-described binder resins to form the charge-transporting layer.

The thickness of the charge-transporting layer is, in general, preferably approximately 5 to 50 μm and more preferably approximately 10 to 30 μm. Examples of a coating method include conventional methods such as a blade coating method, a Mayor bar coating method, a spray coating method, a dip coating method, a bead coating method, an air knife coating method, or a curtain coating method. Further, examples of the solvent to be used for forming the charge-transporting layer include aromatic hydrocarbons such as benzene, toluene, xylene, or chlorobenzene; ketones such as acetone or 2-butanone; halogenated aliphatic alcohol type solvents such as methylene chloride, chloroform, or ethylene chloride; cyclic or straight chain ether solvents such as tetrahydrofuran or ethyl ether. These solvents may be used alone or in combination of two or more of them.

In order to prevent deterioration of the image holding member due to ozone or an acidic gas generated in a copying machine or light or heat, additives such as an antioxidant, a photostabilizer, a heat stabilizer or the like may be added in the photosensitive layer. Examples of the antioxidant include hindered phenol, hindered amine, p-phenylenediamine, arylalkane, hydroquinone, spirochroman, spiroindanone, their compounds, organic sulfur compounds, and organic phosphorus compounds. Examples of the photostabilizer include compounds of benzophenone, benzotriazole, dithiocarbamate, tetramethylpiperidine.

In order to improve the sensitivity, reduce the residual potential and suppress the fatigue at the time of repeated use, at least one electron acceptor substance may be added.

Examples usable as the electron acceptor substance used in the image holding member of the invention include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid and the like. Among them, fluorenone compounds, quinone compounds, and benzene compounds having electron attractive substituent groups such as Cl, CN, $NO_2$ or the like are especially preferable.

Next, a surface protective layer for configuring an uppermost surface of the image holding member 13 according to an exemplary embodiment of the invention will be described. As described above, in the image holding member 13 according to an exemplary embodiment of the invention, the contact angle between the surface of the image holding member 13 and the pure water in the environment of 22° C. 55% RH after the discharge stress is applied must be at least 70 degrees.

In order to set the contact angle between the surface of the image holding member 13 and the pure water under the above condition to at least 70 degrees, resin or low molecular compound containing atoms such as fluorine or silicon is contained in an uppermost surface layer.

Examples of the fluorine-containing resin include tetrafluoroethylene, trifluoroethylene chloride, hexapropylene, vinyl fluoride, vinylidene fluoride, copolymer of difluorodedichloride, copolymer thereof, carbon fluoride, polymer of a fluorine-containing monomer or non-fluorine-containing monomer, a block having a fluorine-containing segment synthesized with copolymer thereof or a graft polymer, a surfactant, and a macro monomer or a combination thereof.

A primary average particle diameter of fluorine-containing resin is preferably 0.05 to 1 μm, and more preferably 0.1 to 0.5 μm. When the primary average particle diameter is less than 0.05 μm, aggregation is easy to be caused upon dispersion and, when the primary average particle diameter is equal to or greater than 1 μm, defect in image quality is easy to be caused.

Examples of the silicon-containing compound include a ternary compound of monomethylsiloxane, a ternary cross-linking material of dimethylsilozane-monomethylsiloxane, polydimethylsiloxane, a block polymer having a polydimethylsiloxane segment, a graft polymer, a surfactant, or a macro monomer, terminal modification polydimethyl siloxane and the like.

In a case of the ternary cross-linking material which is insoluble in a solvent, such as a fluorine-containing particulate or silicon-containing particulate, a particulate may be used. The particulate is dispersed and used as a composition of the uppermost surface layer together with binder resin.

As a dispersing method, a sand mill, a ball mill, a roll mill, a homogenizer, a nanomizer, a paint shaker, an ultrasonic may be used. As an auxiliary dispersion agent, the graft polymer, the block polymer or the surfactant may be used.

These materials is molten and dispersed in an organic solvent together with the other material for configuring the uppermost surface layer (that is, a surface protective layer or a charge transporting layer for configuring the surface of the image holding member when the surface protective layer is not formed) which configures the uppermost surface of the image holding member 13 to form coated liquid and the coated liquid is coated on the surface of the photosensitive layer of the image holding member 13 or the surface of a charge generating layer.

In order to increase abrasion resistance, resin having a cross-linked structure is preferably contained in the surface layer which configures the uppermost surface of the image holding member 13.

Examples of the resin having the crosslinked structure include a phenol-based resin having a cross-linked structure, an urethane-based resin, a siloxane-based resin, an epoxy resin, a melanin resin, and a curable acrylic resin. Among them, the phenol-based resin is preferable. Since the resin having the cross-linked structure has excellent abrasion resistance, it is possible to suppress the surface of the image holding member from be worn or damaged although the resin is used for a long time.

Further, from a viewpoint of the electric properties and image quality maintaining property, the resin having the crosslinked structure preferably has a charge transporting property (include a structure unit having charge transporting capability). In this case, if the image holding member has a layered structure formed by laminating, on a substrate, the charge-generating layer and the charge-transporting layer in this order and further forming a layer containing the resin having the crosslinked structure on the surface of the charge-transporting layer, the layer containing the resin having the crosslinked structure and composing the surface of the image holding member may work as a part of the charge-transporting layer.

By adjusting the content and the material of the resin having the cross-linked structure contained in the uppermost surface layer of the image holding member 13, selecting the resin containing atoms such as fluorine or silicon or a low molecular compound, and adjusting the content of a component for configuring the uppermost surface layer, the contact angle between the surface of the image holding member 13 and the pure water under the above measurement condition after the predetermined discharge stress is applied can be adjusted.

The charging roll 36 charges the surface of the image holding member 13 by the discharge due to the voltage applied from the voltage applying unit 37.

Conventionally-known charging devices may be used as the charging roll 36. When the charging device is that used in a contact charging method, examples of the charging device used as the charging roll 36 include a roll, a brush, a magnetic brush, a blade and the like. When the charging device is that used in a non-contact charging method, examples of the charging device used as the charging roll 36 include corotron, scorotron and the like. The scope of the charging roll 36 is not limited thereto.

Among them, a contact charger is preferably used because charge compensation capability is excellent. The contact charging method includes charging the surface of the image holding member 13 by applying a voltage to a conductive member which is in contact with the image holding member 13. While the shape of the conductive member may be any one of a brush shape, a blade shape, a pin electrode shape and a roll shape, the roll-shape is particularly preferable. In general, the roll-shaped member includes a resistance layer, an elastic layer for supporting the resistance layer, and a core from the outside. If necessary, a protective layer may be further formed on an outer side the resistance layer.

The latent image forming device 40 forms an electrostatic latent image on the image holding member 13 by emitting light modulated according to image data of an image to be formed onto the surface of the image holding member 13.

Conventionally-known exposure devices may be used as the latent image forming device 40. Examples of the exposure device include a laser scanning system, an LED image bar system, analog exposure means, an ion stream control head and the like.

Figure 2:
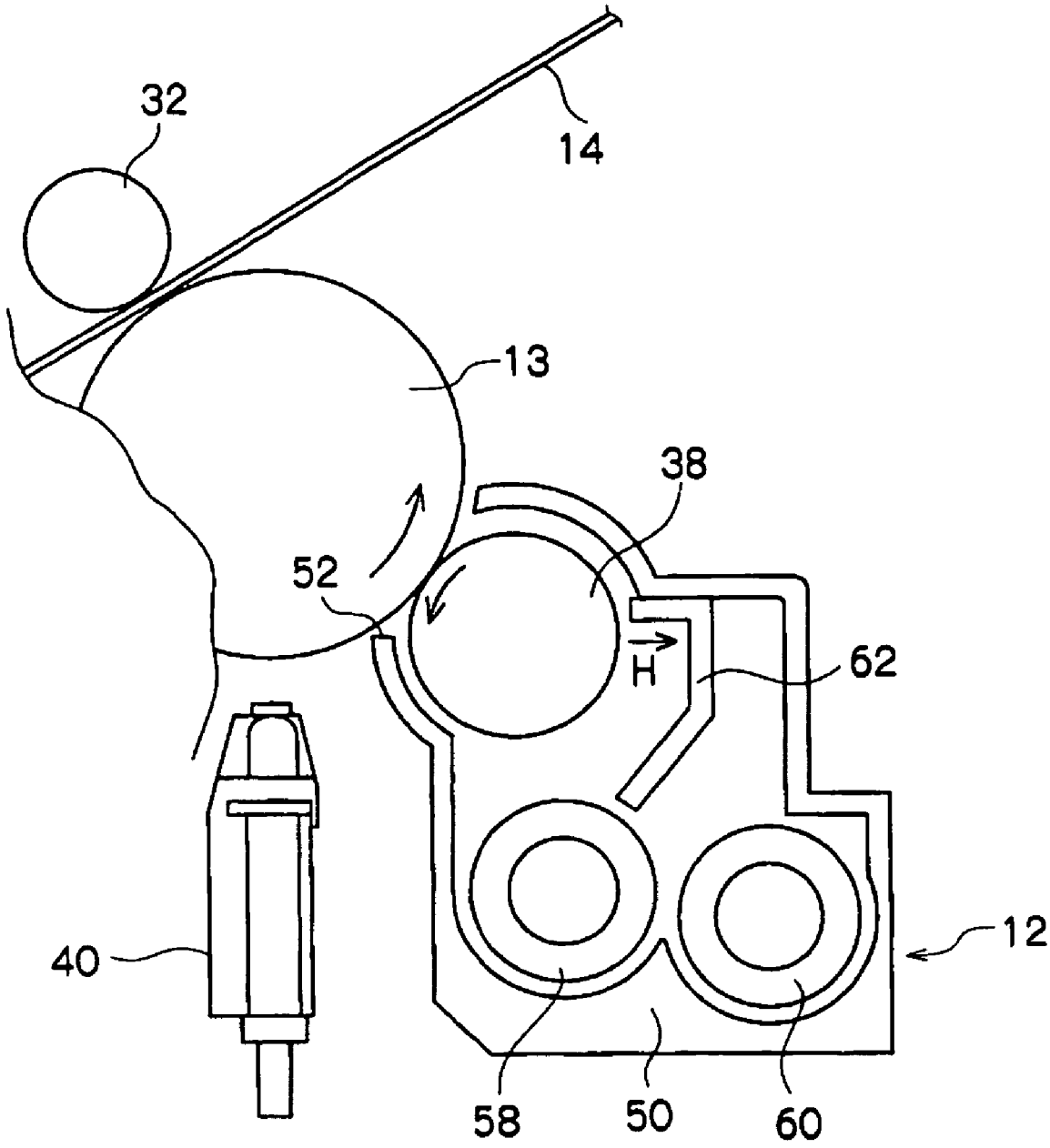
FIG. 2 is a schematic diagram showing the configuration of a portion of a print unit of the image forming apparatus according to the present embodiment.

The developing unit 12 including the developing roll 38 includes a housing 50 as shown in FIG. 2. An opening 52 is formed at a position of the housing 50 which faces the image holding member 13. A portion of the developing roll 38 is exposed from the opening 52. The developing roll 38 includes a magnet roll and a developing sleeve which rotates around the magnet roll. The developing unit 12 is arranged such that a predetermined gap is formed between the image holding member 13 and the developing roll 38.

A screw auger 58 and a screw auger 60 are arranged in the housing 50. The developer (described in detail later) received in the housing 50 is agitated by rotating the screw auger 58 and the screw auger 60 and carried to the developing roll 38. The developing roll 38 rotates in the same rotation direction as that of the image holding member 13.

A trimmer bar 62 is arranged at the upstream side of the rotation direction of the opening 52 of the developing roll 38 in the housing 50 and the thickness of the developer adhered to the surface of the developing sleeve is restricted by the trimmer bar 62. The trimmer bar 62 is arranged in a direction (direction indicated by an arrow H in FIG. 2) which is spaced apart from the developing roll 38. Accordingly, a thick layer is formed on the surface of the developing roll 38 by the developer. That is, since the amount of the developer per unit area increases and the density of the below-described magnetic brush increases, the stripping force of the surface of the image holding member 13 due to the magnetic brush becomes stronger.

While the developer used in the image forming apparatus 10 according to an exemplary embodiment of the invention may be any one of one-component developer including a toner and a two-component developer including a toner and a carrier, the developer preferably further includes any one or both of an abrasive and a lubricant.

The toner used in the invention is not limited by a manufacturing method thereof. Examples of the manufacturing method of the toner include: a kneading pulverization method including kneading a binder resin, a colorant, and a releasing agent, and if necessary a charge controlling agent, and pulverizing and classifying the resultant; a method including changing the shape of particles obtained by the kneading pulverization method by using an impulsive force or heat energy; an emulsification polymerization aggregation method including aggregating, heating and fusing a toner component in a mixture liquid formed by mixing a dispersion liquid formed by emulsifying and polymerizing a polymerizable monomer of binder resin, a colorant dispersion liquid, and if necessary, a dispersion liquid containing a charge controlling agent so as to obtain toner particles; a suspension polymerization method including suspending a liquid containing a polymerizable monomer for obtaining binder resin, a colorant or a releasing agent, and if necessary a charge controlling agent in an aqueous solvent, and polymerizing; and a dissolution suspension method including suspending a liquid including binder resin, a colorant, a releasing agent, and if necessary a charge controlling agent in a aqueous solvent and granulating.

Conventionally-known methods such as a manufacturing method including using the toner obtained by any one of the above-described methods as a core, adhering, heating and fusing binder resin particles so as to provide the toner a core shell structure. Among these manufacturing methods, the suspension polymerization method using the aqueous solvent, the emulsification polymerization aggregation method, and the dissolution suspension method are preferable in view of shape control and particle size distribution control. Among these, the emulsification polymerization aggregation method is particularly preferable.

The toner contains at least the binder resin, the colorant and the releasing agent. If necessary, the toner may further contain the charge controlling agent, silica an the like. The volume-average diameter of the toner is preferably in a range of approximately 2 to 12 μm, and more preferably in a range of approximately 3 to 9 μm. As described above, it is possible to obtain an image having a high development property, a high transfer property and high quality by using the toner having the average form exponent SF of approximately 100 to 140. Particularly, in the invention using the magnetic brush as the cleaning means, with respect to the transfer property, it is preferable that a conglobation degree of the toner is high in order to maintain high transfer property.

Examples of the binder resin of the toner include polymers and copolymers of styrenes such as styrene or chlorostyrene; monoolefins such as ethylene, propylene, butylene or isoprene; vinyl esters such as vinyl propionate, vinyl benzoate or vinyl butyrate; α-methylene aliphatic monocarboxylate esters such as methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate; vinyl ethers such as vinyl methyl ether, vinyl ethyl ether or vinyl butyl ether; vinyl ketones such as vinyl methyl ketone, vinyl hexyl ketone, or vinyl isopropenyl ketone; and the like.

Examples of particularly representative binder resin include polystyrene, styrene-alkyl acrylate copolymer, styrene-alkyl metacrylate copolymer, styrene-acrylonitrile copolymer, styrene-butadiene copolymer, styrene-maleic anhydride copolymer, polyethylene, polypropylene and the like. Examples of particularly representative binder resin further include polyester, polyurethane, epoxy resin, silicon resin, polyamide, modified rhodine, paraffin wax and the like.

Examples of the colorant of the toner include magnetic powder such as magnetite or ferrite, carbon black, aniline blue, Calco Oil Blue, chrome yellow, ultramarine blue, Dupont oil red, quinoline yellow, methylene blue chloride, phthalocyanine blue, malachite green oxalate, lampblack, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. and Pigment Blue 15:3.

Examples of representative releasing agent include low molecular polyethylene, low molecular polypropylene, Fischer Tropsch wax, montan wax, carnauba wax, rice wax, and Candelilla wax.

If necessary, a charge controlling agent may be added to the toner. Conventionally-known agents can be used as the charge controlling agent. Examples thereof include an azo metal complex compound, a metal complex compound of salicylic acid, and a resin charge controlling agent containing a polar group. When the toner is manufactured using a wet process, a material which is hardly dissolved in water is preferably used in view of control of an ionic strength and reduction of wastewater contamination. The toner according to an exemplary embodiment of the invention may be any one of a magnetic toner containing a magnetic material and a non-magnetic toner containing no magnetic material.

When a spherical inorganic particulate or organic particulate having an average particle diameter of approximately 50 nm to 150 nm is added to the toner used in the invention as an external additive, the transfer property of the toner further improves. The collection of the toner by a developing unit is significantly improved in a state where the magnetic brush is driven in a general condition for collecting a remaining toner upon forming an image.

Examples of the organic particulate include acrylic resin particles, styrene acrylic resin particles, polyester resin particles, urethane resin particles and the like. Preferable examples of the inorganic particulate include silica.

When the particle diameter is too large or small, it is difficult to obtain the effects described above. Accordingly, the average particle diameter of the external additive is preferably in a range of approximately 50 to 200 nm and more preferably in a range of approximately 100 to 160 nm.

The amount of the external additive having the average particle diameter of the range of approximately 50 to 200 nm is preferably at least about 0.1% by mass, and more preferably about 0.5% by mass.

Conventionally-known abrasive may be used as an abrasive which is added to the toner used in the invention in order to remove and uniformly scrape adhering inpurities on the surface of the image holding member 13. Among them, an inorganic particulate is particularly preferable in view of excellent abrasion property.

Examples of the inorganic particulate include various inorganic oxides nitrides and borides such as ceric oxide, alumina, silica, titania, zirconia, barium titanate, aluminum titanate, strontium titanate, magnesium titanate, zinc oxide, chrome oxide, antimony oxide, tungsten oxide, tin oxide, tellurium oxide, manganese oxide, boron oxide, silicon carbide, boron carbide, titanium carbide, silicon nitride, titanium nitride, boron nitride, or the like.

The inorganic particulate may be treated with a titanate coupling agent such as tetrabutyl titanate, tetraoctyl titanate, isopropyl triso stearoyl titanate, isopropyl tridecyl benzene sulfonyl titanate, bis-(dioctyl pyrophosphate) oxyacetate titanate or the like, or a silane coupling agent such as γ-(2-amino ethyl)amino propyl trimethoxysilane, γ-(2-amino ethyl)amino propyl methyl dimethoxysilane, γ-methacryloxy propyl trimethoxysilane, N-β-(N-vinyl benzyl amino ethyl) γ-amino propyl trimethoxysilane hydrochloride, hexamethyldisilazane, methyl trimethoxysilane, butyl trimethoxysilane hydrochloride, iso-butyl trimethoxysilane, hexyl trimethoxysilane, octyl trimethoxysilane, decyl trimethoxysilane, dodecyl trimethoxysilane, phenyl trimethoxysilane, o-methyl phenyl trimethoxysilane, p-methyl phenyl trimethoxysilane or the like. Examples of the abrasive further include an abrasives which is subjected to a hydrophobic property-imparting using higher an aliphatic acid metal salt such as silicon oil, zinc stearate, calcium stearate or the like.

The particle diameter of the abrasive is preferably in a range of approximately 50 nm to 10 μm and more preferably in a range of approximately 100 nm to 1 μm. When the particle diameter of the abrasive is less than about 50 nm, the polishing effect may become insufficient, and, when the particle diameter of the abrasive is larger than about 1 μm, the surface of the latent image holding member may be damaged in the rotation direction.

The amount of the abrasive is preferably about 0.1% by weight and more preferably about 0.2% by weight with respect to the amount of the toner. When the amount of the abrasive is less than about 0.1% by weight, the polishing effect may become insufficient and a variety of foreign materials on the surface of the latent image holding member may not be sufficiently removed. While it is preferable that the amount of the abrasive is large in order to sufficiently ensure the polishing effect, it is simultaneouly preferable that the amount of the abrasive is equal to or less than about 1.0% by weight in view of the toner charging property.

Examples of the other inorganic oxide added to the toner include a small-diameter inorganic oxide having a primary particle diameter of approximately 50 nm or less in consideration of fine particle mobility or charge controlling, and an inorganic oxide having a diameter larger than the small-diameter inorganic oxide in consideration of reduction of adherence or charge controlling. Known particulates may be used as these inorganic oxide particulates. In view of performing precise charge controlling, it is preerable to use silica and titanium oxide in combination. When the small-diameter inorganic particulate is subjected to a surface treatment, it becomes possible to increase dispersibility and improve fine particle mobility thereof.

A lubricant may be further externally added to the toner used in the invention in order to form a protective film on the surface of the image holding member, adhere a foreign material such as products formed by electric discharge or a toner on the protective film, and remove the foreign material from the image holding member. Examples of the lubricant include: a solid lubricant such as graphite, molybdenum disulphide, talc, aliphatic acid, or metallic salt of aliphatic acid; low molecular polyolefins such as polypropylene, polyethylene or polybutene; silicons having softening point upon heating; aliphatic acid amides such as amide oleate, amide erucite, amide ricinoleate, or amide stearate; plant waxes such as carnauba wax, rice wax, Candelila wax, Japan wax or jojoba oil wax; animal waxes such as bees wax; mineral waxes and oil waxes such as montan wax, ozokerite, ceresin, paraffin wax, microcrystalline wax, or Fischer-Tropsch wax; and a modified material of these. Any of these lubricants may be used singly or in combination.

The external additives may be added to the toner by Henschel mixer, V blender or the like. In addition, when the toner particle is manufactured in a wet method, the external additives may be added in a wet method.

The amount of the lubricant is preferably at least about 0.05% by weight and more preferably 0.1% by weight with respect to the amount of the toner.

When both the abrasive and the lubricant are not externally added to the toner, since the surface of the image holding member 13 has high hardness, the single use of the cleaning blade 66 cannot ensure any one or both of the sufficient abrasing property and the formation of the protective layer on the surface of the image holding member, and thus the foreign material on the surface of the image holding member 13 cannot be uniformly and sufficiently removed. As a result, when an image is formed over a longer period, the products formed by electric discharge cannot be sufficiently removed and thus a white spot may occur.

A carrier which can be used in a two-component developer is not specially limited, and a known carrier can be used. Examples of the carrier include magnetic metals such as iron oxide, nickel or cobalt, magnetic oxides such as ferrite or magnetite, resin-coated carriers having a resin covering layer on a surface of a core formed of these metal or metallic compounds, and magnetic dispersion carriers. Examples of the carrier further include a resin dispersion carrier in which a conductive material is dispersed in a matrix resin.

While examples of the matrix resin and the coated resin used in the carrier include polyethylene, polypropylene, polystyrene, polyvinyl acetate, polyvinyl alcohol, polyvinyl butyral, polyvinyl chloride, polyvinyl ester, polyvinyl ketone, vinyl chloride-vinyl acetate copolymer, styrene-acrylate copolymer, straight silicon resin having an organosiloxane bond or a modified material thereof, fluorine resin, polyester, polycarbonate, phenol resin, epoxy resin and the like, the matrix resin and the coated resin are not limited thereto.

Examples of the conductive material include metals such as gold, silver or copper, carbon black, titanium oxide, zinc oxide, barium sulfate, aluminum borate, potassium titanate, tin oxide and the like, while the scope of the conductive material is not limited thereto.

Examples of the material for forming the core of the carrier include magnetic metals such as iron, nickel or cobalt, magnetic oxides such as ferrite or magnetite, glass beads and the like. In view of using the carrier in a magnetic brush method, the magnetic material is preferably used as the material for forming the core.

The volume-average particle diameter of the core of the carrier is generally approximately 10 to 500 μm, and preferably approximately 30 to 100 μm.

Examples of a method to coat the surface of the core of the carrier with the resin include a method having coating the surface of the core by using a coating liquid for forming a coated layer in which the resin for coating the core are dissolved in a proper solvent. The coating liquid may further contain various additives in accordance with necessity. The solvent is not specially limited, and may be appropriately selected in consideration of the coated resin and coat suitability.

Concrete examples of the resin coating method include: an immersing method including immersing the core of the carrier in the liquid for forming the coated layer; a spray method including spraying the liquid for forming the coated layer onto the surface of the core of the carrier; a fluid bed method including spraying the liquid for forming the coated layer onto the core of the carrier which is floated by air flow; and a kneader coater method including mixing the liquid for forming the coated layer with the core of the carrier in a kneader coater and removing the solvent may be used.

The mixting ratio (weight ratio) of the toner to the carrier according to an exemplary embodiment of the invention in the two-component developer is preferably in a range of approximately 1:100 to 30:100, and more preferably in a range of approximately 3:100 to 20:100.

The transfer roll 32 transfers the toner image formed on the image holding member 13 by the development using the developing roll 38 onto the intermediate transfer belt 14. Conventionall-known transfer device may be used as the transfer roll 32. For example, when the transfer is performed in a contact method, a roll, a brush, a blade or the like may be used as the transfer roll 32. When the transfer is performed in a non-contact method, corotron, scorotron, pin corotron or the like may be used as the transfer roll 32. Alternatively, the transfer may be performed by using pressure or pressure and heat.

The cleaning blade 66 has an elongated plate shape. One end of a longitudinal direction thereof is in contact with the surface of the image holding member 13 in the rotation direction. The cleaning blade 66 is provided such that the end surface, which is in contact with the image holding member 13, among the end surfaces of the longitudinal direction is placed in an antigravity direction. Accordingly, the removed adhering impurities can fall toward a gravity direction, and thus the foreign material can be efficiently removed from the surface of the image holding member 13.

In the cleaning blade 66, a material of at least a portion to be brought into contact with the surface of the image holding member 13 satisfies the following inequalities (1) to (3).

$$3.92 \leqq M \leqq 29.42; \quad \text{Inequality (1)}$$

$$0 < \alpha \leqq 0.294; \text{ and} \quad \text{Inequality (2)}$$

$$S \geqq 250; \quad \text{Inequality (3)}$$

In the inequalities (1) to (3), M denotes 100% modulus (MPa); $\alpha$ denotes the ratio {Δstress/Δstrain degree=(stress at 200% strain degree−stress at 100% strain degree)/(200−100)} (MPa/%) of the change in stress (Δstress) to the change in strain (Δstrain) in a range of 100% to 200% strain degree in the stress-strain curve; and S denotes the breaking elongation (%) measured according to ISO 37:2005 (using a dumbbell-type No. 3 test piece.

With respect to the cleaning blade 66 used in the image forming apparatus 10 of the invention, since the material for a portion to be brought into contact with the surface of the image holding member 13 (hereinafter the portion is referred to as an edge part or an edge tip end or the material composing the portion is referred to as an edge part material or an edge tip end material in some cases) satisfies the inequality (1), the cleaning blade is excellent in wear resistance while exhibiting good cleaning capability.

If the 100% modulus M is less than about 3.92 MPa (about 40 kgf/cm$^2$), the wear resistance becomes insufficient and the cleaning capability cannot be kept good for a long duration. On the other hand, if it exceeds about 29.42 MPa (about 300 kgf/cm$^2$), the edge material is so hard that it deteriorates the capability of following to the image holding member 13 and thus no good cleaning capability is provided. Additionally, the surface of the object member to be cleaned may sometimes be scratched.

The 100% modulus M is preferably in a range of approximately 5 to 20 MPa and more preferably in a range of approximately 6.5 to 15 MPa.

Since the edge material satisfies the inequality (2) and the inequality (3), the cleaning blade is excellent in the cracking resistance. In the case where a in the inequality (2) exceeds about 0.294, the edge material is insufficient in flexibility. Therefore, along with occurrence of BCO, just like foreign materials buried and fixed in the surface of an image holding member 13, when foreign materials existing in the surface of the image holding member 13, specially foreign materials buried and fixed in the surface, repeatedly pass the contact part of the image holding member 13 and the cleaning blade 66 and high stress is thus repeatedly applied to the edge tip end of the cleaning blade 66, the edge tip end cannot be so deformed as to efficiently diffuse the stress and accordingly the edge is cracked within a relatively short period. Consequently, because of the cracking in an early stage, it is impossible to maintain a good cleaning capability for a long duration.

The value of $\alpha$ is preferably about 0.2 or lower and more preferably about 0.1 or lower and it is better as the value $\alpha$ is closer to 0, which is the ultimate lower limit of the physical property.

Further, if the breaking elongation S defined by the inequality (3) is lower than about 250%, when foreign materials which exist in the surface of the image holding member 13 and are to be cleaned and the edge tip end come into collision with a high force against each other, the edge tip end is drawn and cannot following the deformation and for that, the edge cracking occurs within a relatively short time. Consequently, because of the cracking in an early stage, it is impossible to maintain a good cleaning capability for a long duration.

The breaking elongation is preferably approximately 300% or higher and more preferably approximately 350% or higher and thus it is more preferable as it is higher, however in terms of the availability of a raw material composing the edge part material, it is preferable to be 800% or lower.

The 100% modulus M defined by the inequality (1) is calculated from the stress at the time of 100% strain by measurement at 500 mm/min pulling speed using a dumbbell-type No. 3 test piece according to ISO 37:2005. Strograph AE elastomer (trade name, manufactured by Toyo Seiki Co., Ltd.) is used as the measuring apparatus.

The value $\alpha$ defined by the inequality (2) is calculated from the stress-strain curve and the stress and the strain degree are calculated by the following procedure and method. That is, the measurement is carried out at 500 mm/min pulling speed using a dumbbell-type No. 3 test piece according to ISO 37:2005 to measure the stress at the time of 100% strain and the stress at the time of 200% strain. STROGRAPH AE elastomer (trade name, manufactured by Toyo Seiki Co., Ltd.) is used as the measuring apparatus.

As described, the cleaning blade 66 provided to the image forming apparatus 10 of the invention is excellent in both wear resistance and cracking resistance and maintaining good cleaning capability for a long duration.

Accordingly, unlike a conventional case, it is not necessary to install a new apparatus for improving the wear resistance and cracking resistance additionally in an image forming apparatus so as to solve a problem of foreign materials existing in the surface of the image holding member 13, specially foreign materials buried and fixed in the surface, just like foreign materials buried and fixed in the surface of an image holding member 13 along with occurrence of BCO (Bead Carry Over: the phenomenon of transferring of a portion of magnetic carriers to the surface of the image holding member 13 due to electrostatic attracting force), and therefore enlargement and cost up of the apparatus can be avoided.

In addition, since the life of the cleaning blade 66 is prolonged, the image forming apparatus 10 having the cleaning blade 66 can be provided with long lives and their maintenance cost is made easy to be low. Specially, if the image forming apparatus has both of an image holding member 13 with improved wear resistance of the surface and the cleaning blade 66 of the invention, the image forming apparatus is more advantageous in the above-mentioned properties.

With respect to the cleaning blade 66 of the invention, at least the edge material is a material satisfying the inequalities (1) to (3). Not only the edge part but also other parts may be made of the material satisfying the inequalities (1) to (3).

While the material satisfying the inequalities (1) to (3) is not particularly limited, it is particularly preferable that the material is an elastomer material containing hard segments and soft segments. Containing both hard segments and soft segments, the elastomer material can easily satisfy the physical properties defined by the inequalities (1) to (3) and can provide both of high wear resistance and high cracking resistance.

Herein, "hard segments" and "soft segments" mean that the material composing the former is a material relatively harder than the material composing the latter and the material composing the latter is a material relatively softer than the material composing the former.

The elastomer material containing hard segments and soft segments is preferable to have a glass transition temperature in a range of approximately −50 to 30° C. and more preferably in a range of approximately −30 to 10° C. If the glass transition temperature exceeds about 30° C., the cleaning blade may possibly become fragile in a temperature range for practical use of the cleaning blade. If the glass transition temperature is lower than about −50° C., the cleaning blade may sometimes not be provided with sufficient hardness and stress in a range for practical use.

Consequently, to realize the above-mentioned glass transition temperature, the glass transition temperature of a material composing the hard segments in the elastomer material (hereinafter, sometimes referred to as a hard segment material) is preferably in a range of approximately 35 to 100° C. and more preferably in a range of approximately 35 to 60° C. and the glass transition temperature of a material composing the soft segments in the elastomer material (hereinafter, sometimes referred to as a soft segment material) is preferably in a range of approximately −100 to −50° C. and more preferably in a range of approximately −90 to −60° C.

Further, in the case of using the hard segment material and the soft segment material having the above-mentioned glass transition temperatures, the weight ratio of the hard segment material with respect to the total weight of the hard segment material and the soft segment material (hereinafter, sometimes referred to as hard segment material ratio) is preferably in a range of approximately 46 to 96% by weight, more preferably in a range of approximately 50 to 90% by weight, and even more preferably in a range of approximately 60 to 85% by weight.

If the hard segment material ratio is less than about 46% by weight, the wear resistance of the edge tip end becomes so insufficient as to cause wear in an early stage and accordingly the good cleaning property cannot be maintained for a long duration in some cases. If the hard segment material ratio exceeds about 96% by weight, the edge tip end becomes too hard to maintain sufficient flexibility and drawability and cracking occurs in an early stage and accordingly, the good cleaning property cannot be maintained for a long duration in some cases.

The combination of the hard segment material and the soft segment material is not particularly limited and materials may be selected from conventionally known resin materials such that one is relatively harder than the other or one is relatively softer than the other. Preferable examples of the combinations used in this invention include the followings.

Namely, a polyurethane resin is preferable to be used as the hard segment material. In this case, the weight average molecular weight of the polyurethane is preferably in a range of approximately 1,000 to 4,000 and more preferably in a range of approximately 1,500 to 3,500.

In the case where the weight average molecular weight is lower than about 1,000, if the cleaning blade is used in a low temperature environment, the elasticity of the polyurethane resin composing the hard segments is lost, and cleaning failure sometimes tends to occur easily. If the weight average molecular weight exceeds about 4,000, the permanent strain of the polyurethane resin composing the hard segments becomes significant and the edge tip end cannot maintain the contact force to the image holding member 13 to result in cleaning failure in some cases.

Examples of the polyurethane resin to be used as the above-mentioned hard segment material include Placcel 205 and Placcel 240 (both trade name, manufactured by Daicel Chemical Industries, Ltd.).

Also, as the soft segment material in the case of using the polyurethane resin as the hard segment material, it is preferable to use (1) a resin having a functional group reactive to isocyanate group. Further, it is preferable that the resin has physical properties of: (2) a glass transition temperature of about 0° C. or lower; (3) a viscosity of approximately 600 to 35,000 MPa·s at 25° C.; and (4) a weight average molecular weight in a range of approximately 700 to 3,000. If these physical properties are not satisfied, the formability at the time of producing the cleaning blade sometimes is insufficient or the properties of the cleaning blade may sometimes be insufficient. The physical properties are more preferable to be as follows: the glass transition temperature is about −10° C. or lower; the viscosity at about 25° C. is in a range of approximately 1,000 to 3,000 MPa·s; and the weight average molecular weight is in a range of approximately 900 to 2,800. In the case where the cleaning blade 66 is produced by centrifugal molding, the viscosity is preferably in a range of approximately 600 to 3,500 MPa·s at 25° C.

The soft segment material satisfying the structure and physical properties (1) to (4) may be appropriately selected from conventionally-known resins. It is preferable that the soft segment material is a soft resin having a functional group reactive to an isocyanate group in at least a terminal thereof. Further, the resin is preferably an aliphatic resin having a straight chain structure in view of flexibility. Specific examples thereof include acrylic resins having two or more hydroxyl groups, polybutadiene resins having two or more hydroxyl groups, and epoxy resins having two or more epoxy groups.

Examples of the acrylic resins having two or more hydroxyl groups include ACTFLOW (grade: UMB-2005B, UMB-2005P, UMB-2005, UME-2005, and the like: all trade names, manufactured by Soken Chemical Engineering Co., Ltd.). Examples of the polybutadiene resin having two or more hydroxyl groups include R-45HT (trade name, manufactured by Idemitsu Kosan Co., Ltd.).

The epoxy resin having two or more epoxy groups are preferably those which are more flexible and tougher than conventional ordinary epoxy resins, which are hard and fragile.

In terms of molecular structure, preferable examples of such epoxy resins include those having, in the main chain structure thereof, a structure (a flexible skeleton) that can provide high flexibility to the main chain. Examples of the flexible skeleton include an alkylene skeleton, a cycloalkane skeleton, and a polyoxyalkylene skeleton. Among these, the polyoxyalkylene skeleton is particularly preferable.

In terms of the physical properties, epoxy resins with a low viscosity in relation to the molecular weight as compared with that of conventional epoxy resins are preferable. More concretely, the weight average molecular weight of the epoxy resins used in the invention is preferably in a range of approximately 900±100, and the viscosity of the epoxy resins used in the invention at 25° C. is preferably in a range of approximately 15,000±5,000 MPa·s and more preferably in a range of approximately 15,000±3,000 MPa·s. Examples of the epoxy resin having such properties include EPLICON EXA-4850-150 (trade name, manufactured by Dainippon Ink and Chemicals, Inc.) and the like.

While the cleaning blade 66 of the invention is not particularly limited as long as at least the material of the portion to be brought into contact with the surface of the image holding member 13 is made of a material satisfying the inequalities (1) to (3) as described above, the entire body of the cleaning blade 66 may be made of such a material. In the case where the cleaning blade 66 has a layered structure composed of two or more layers, the layer to be brought into contact with surface of the image holding member 13 is preferably made of the material satisfying the inequalities (1) to (3).

Conventionally-known methods can be employed as the production method of the cleaning blade of the invention depending on the raw materials to be used for producing the cleaning blade 66, and examples thereof include a method in which the cleaning blade 66 is produced by forming a sheet by centrifugal molding or extrusion molding and cutting the sheet into a predetermined shape, and a method in which the cleaning blade 66 is produced by adhering two or more sheets.

Use of the cleaning blade 66 of the invention can suppress occurrence of cracking attributed to foreign materials such as carrier flakes buried and fixed in the surface of the image holding member 13 owing to occurrence of BCO, and at the same time, clean out foreign materials such as a toner, an external additive, products formed by electric discharge, talc or paper powder adhered to the surface of the image holding member 13 stably for a long duration.

As described above, the charging roll 36 applies direct current and/or alternating current at a high voltage to uniformly charge the image holding member 13. At this time, the charging roll 36 chemically changes oxygen or nitrogen in air and generates products formed by electric discharge such as ozone or nitrogen oxide.

As described above, The removal of the products formed by electric discharge on the image holding member 13 while simultaneously improving abrasion resistance of the image holding member 13 and the cleaning blade 66 can be achieved by providing a configuration of the developer so as to contain an abrasive or a lubricant, improving the abrasion resistance of the uppermost surface layer of the image holding member 13 while using the material which satisfies Inequalities (1) to (3) in at least a portion which is in contact with the surface of the image holding member 13 of the cleaning blade 66.

Next, the operation of the present embodiment will be described.

When the image holding member 13 rotates in a counterclockwise rotation direction in FIG. 1, first, the surface of the image holding member 13 is uniformly charged with a predetermined polar potential by the charging roll 36. When the image holding member 13 rotates, the charged surface of the outer circumference of the image holding member 13 is exposed by the latent image forming device 40 and the potential of the exposed portion of the charged surface is reduced to form an electrostatic latent image. Thereafter, the toner having the same polarity as the charged polarity of the image holding member 13 is electrically adhered to the potential reducing portion of the charged surface by the developing roll 38, and the electrostatic latent image is developed so as to form a toner image.

When the toner image formed on the image holding member 13 reaches a region which faces the transfer roll 32 applied with a transfer voltage having a reverse polarity of the toner, the toner image is electrically pulled to the transfer roll 32 and transferred onto the intermediate transfer belt 14.

In the image forming apparatus 10 according to an exemplary embodiment of the invention, in the region in which the image holding member 13 and the intermediate transfer belt 14 face each other, the relationship between the movement speed Sp of the image holding member 13 and the movement speed Sb of the intermediate transfer belt 14 need be different from each other. The relationship between the movement speed Sp and the movement speed Sb is preferably satisfies the following Inequality (4) or Inequality (5).

$$1.01 \leqq Sb/Sp \leqq 1.05 \qquad \text{Inequality (4)}$$

$$1.01 \leqq Sp/Sb \leqq 1.05 \qquad \text{Inequality (5)}$$

The relationship between the movement speed Sp of the image holding member 13 and the movement speed Sb of the intermediate transfer belt 14 is preferably satisfies the following Inequality (6) or Inequality (7).

$$1.015 \leqq Sb/Sp \leqq 1.035 \qquad \text{Inequality (6)}$$

$$1.015 \leqq Sp/Sb \leqq 1.035 \qquad \text{Inequality (7)}$$

In the image forming apparatus 10 according to an exemplary embodiment of the invention, when a difference between the movement speed Sp of the image holding member 13 and the movement speed Sb of the intermediate transfer belt 14 in the region in which the image holding member 13 and the intermediate transfer belt 14 face each other is equal to or larger than about 1% and equal to or less than about 5% as expressed by Inequality (4) or (5), the products formed by electric discharge on the image holding member 13 can be easily removed due to the friction between the image holding member 13 and the intermediate transfer belt 14.

Meanwhile, when the difference between the movement speed Sp of the image holding member 13 and the movement speed Sb of the intermediate transfer belt 14 is less than about 1%, the products formed by electric discharge may tend to be accumulated on the surface of the photosensitive body. In addition, when the difference between the movement speed Sp of the image holding member 13 and the movement speed Sb of the intermediate transfer belt 14 is greater than about 5%, a driving speed may be changed due to the difference of the speeds and thus a concentration irregularity may occur in the transfer unit.

In order to adjust the movement speed of the image holding member 13 and the movement speed of the intermediate transfer belt 14 in the region in which the image holding member 13 and the intermediate transfer belt 14 face each other so as to satisfy the relationship shown in Inequality (4) or Inequality (5), for example, a first motor (not shown in FIG. 1) for rotating the support shaft may be provided in a rotation shaft (not shown in FIG. 1) of the image holding member 13 through a plurality of gears and the support shaft. One of the plurality of rolls which rotates while stretching the intermediate transfer belt 14 (for example, the driving roll 24B) is used as a driving roll. A second motor (not shown in FIG. 1) for rotating the support shaft is provided in a rotation shaft (not shown in FIG. 1) of the driving roll 24B through the plurality of gears and the support shaft. The rotation speed of the image holding member 13 and the intermediate transfer belt 14 may be adjusted such that Inequality (4) or Inequality (5) is satisfied as a result of driving the first motor and the second motor to control the driving of the motors by a control unit for controlling the image forming apparatus 10 (not shown in FIG. 1) so that the driving forces of the motors are respectively delivered to the image holding member 13 and the intermediate transfer belt 14 through the gears.

After the toner image is transferred onto the intermediate transfer belt 14, the surface of the image holding member 13 is scraped by the cleaning blade 66. The cleaning blade 66 removes a remaining toner, which is not used for the transfer onto the intermediate transfer belt 14, or the products formed by electric discharge adhered to the surface image holding member 13 from the surface of the image holding member 13.

EXAMPLES

In order to confirm the operation of an embodiment of the invention, the following experiments are performed.

Manufacture of Toner

First Process:

| Preparation of Dispersion liquid 1 | |
|---|---|
| Styrene | 370 g |
| n-butyl acrylate | 30 g |
| Acrylic acid | 8 g |
| Dodecanethiol | 24 g |
| Carbon tetrabromide | 4 g |

The above materials are mixed so as to be in a dissolved state. The resultant are dispersed in 550 g of ion-exchanged water, in which 6 g of a nonionic surfactant (trade name: NONIPOL 400, manufactured by Sanyo Chemical Industries, Ltd.) and 10 g of an anionic surfactant (trade name: NEOGEN SC, manufactured by Dai-ichi Kogyo Seiyaku Co., Ltd.) are dissolved in a flask, and emulsified and slowly mixed for ten minutes. 50 g of ion-exchanged water in which 4 g of sodium persulphate is dissolved is introduced thereto so that nitrogen substitution occurs therein, and the contents are heated to 70° C. in an oil bath while stirring the inside of the flask, and emulsification polymerization is continuously performed for five hours.

As a result, the dispersion liquid 1 formed by dispersing resin particles having an average particle diameter of 155 nm, a glass transition point of 59° C. and a weight-average molecular weight (Mw) of 12,000 is prepared.

| Preparation of Dispersion liquid 2 | |
|---|---|
| Styrene | 280 g |
| n-butyl acrylate | 120 g |
| Acrylic acid | 8 g |

The above materials are mixed so as to be in a dissolved state. The resultant is dispersed in 550 g of ion-exchanged water, in which 6 g of a nonionic surfactant (trade name: NONIPOL 400, manufactured by Sanyo Chemical Industries, Ltd.) and 12 g of an anionic surfactant (trade name: NEOGEN SC, manufactured by Dai-ichi Kogyo Seiyaku Co., Ltd.) are dissolved in a flask, and emulsified and slowly mixed for ten minutes. 50 g of ion-exchanged water in which 3 g of sodium persulphate is dissolved is introduced thereto so that nitrogen substitution occurs therein, and the contents are heated to 70° C. in an oil bath while stirring the inside of the flask, and emulsification polymerization is continuously performed for five hours.

As a result, the dispersion liquid 2 formed by dispersing resin particles having an average particle diameter of 105 nm, a glass transition point of 53° C. and a weight-average molecular weight (Mw) of 550,000 is prepared.

| Preparation of Colorant dispersion liquid 1 | |
|---|---|
| Carbon black (trade name: MOGUL ®, manufactured by Cabot) | 50 g |
| Nonionic surfactant (trade name: NONIPOL 400, manufactured by Sanyo Chemical Industries, Ltd.) | 5 g |
| Ion-exchanged water | 200 g |

The above materials are mixed so as to be in a dissolved state. The resultant is subjected to dispersing process by using a homogenizer (trade name: ULTRATURRAX T50, manufactured by IKA) for ten minutes. As a result, the colorant dispersion liquid 1 formed by dispersing the colorant (carbon black) having an average particle diameter of 250 nm is prepared.

| Preparation of Releasing agent dispersion liquid 1 | |
|---|---|
| Paraffin wax (trade name: HNPO190, m.p.: 190° C., manufactured by Nippon Seiro Co., Ltd.) | 50 g |
| Cationic surfactant (trade name: SANISOL B-50, manufactured by Kao Corporation) | 5 g |
| Ion-exchanged water | 200 g |

The above materials are heated to 95° C. The resultant is subjected to dispersing process by using a homogenizer (trade name: ULTRATURRAX T50, manufactured by IKA), and further subjected to dispersing process by using a pressure discharging homogenizer. As a result, the releasing agent dispersion liquid 1 formed by dispersing the releasing agent having an average particle diameter of 550 nm is prepared.

| Preparation of Aggregated particle | |
|---|---|
| Dispersion liquid 1 | 120 g |
| Dispersion liquid 2 | 80 g |
| Colorant dispersion liquid 1 | 30 g |
| Releasing agent dispersion liquid 1 | 8 g |
| Cationic surfactant (trade name: SANISOL B-50, manufactured by Kao Corporation) | 1.5 g |

The above materials are mixed in a round flask formed of stainless steel so as to be in a dissolved state by using a homogenizer (trade name: ULTRATURRAX T50, manufactured by IKA). The resultant is heated to 48° C. in an oil bath while stirring the inside of the flask. After keeping the resultant at 48° C. for 30 minutes, an observation using an optical microscope is conducted so as to confirm the formation of aggregated particles having an average particle diameter of about 5 μm (volume: 95 $cm^3$).

Second Process:

Preparation of Adhered Particles 60 g of the dispersion liquid 1 is gently added to the aggregated particle reaction product liquid as resin-containing particulate dispersion liquid. The volume of the resin particle contained in the dispersion liquid 1 is 25 $cm^3$. The temperature of the heating oil bath is increased to 50° C. and maintained for one hour. It is confirmed that the adhered particles having an average particle diameter of about 5.7 μm are formed through observation using an optical microscope.

Third Process:

Thereafter, 3 g of the anionic surfactant (trade name: NEOGEN SC, manufactured by Dai-ichi Kogyo Seiyaku Co., Ltd.) is added to the adhered particle reaction product liquid and the stainless flask is sealed, heated to 105° C. while agitation is continued using magnetic seal, and maintained for three hours.

Then, the reaction product is filtered after cooling, sufficiently cleaned with ion-exchanged water, and dried.

Preparation of Toner A 0.5 parts by weight of zinc stearate (average particle diameter of 10 μm) as a lubricate, 1.0 parts by weight of a cerium oxide (average particle diameter of 0.5 μm) as an abrasive, 0.8 parts by weight of titanium oxide which is subjected to surface treatment (trade name: MT3103, manufactured by Tayca Corporation) as a charge controlling particle, and 0.85 parts by weight of silica which is subjected to surface treatment (trade name: RX515H, manufactured by Nippon Aerosil Co., Ltd.) are added to 100 parts by weight of a reaction product obtained by the first to third processes and an external additive is blended in Henschel mixer, thereby obtaining a toner (toner A) used in the image forming apparatus according to an exemplary embodiment of the invention.

Preparation of Image Holding Member

Preparation of Image Holding Member A 20 parts by weight of an organic zirconium compound (acetyl acetone zirconium butoxide, trade name: ORGATIX ZC 540, manufactured by Matsumoto Kosho Ltd.), and 2 parts by weight of an organic silane compound (γ-aminopropyl triethoxysilane, trade name: A1100, manufactured by Nihonunica Corporation) is added to 70 parts by weight of n-butyl alcohol in which 1.5 parts by weight of polyvinyl butyral resin (trade name: S-LEC BM-S, manufactured by Sekisui Chemical Co., Ltd.) and agitated to obtain a coating liquid for forming an underlying layer.

The coating liquid is coated by an immersion method on an ED pipe aluminum substrate body having a diameter of 30 mm, of which the surface is roughened by a wet honing process. The resultant is introduced into a hot air drier, and dried at 150° C. for ten minutes, thereby forming the underlying layer having a thickness of 0.9 μm.

Next, a mixture including 5 parts by weight of x-type metal-free phthalocyanine, 5 parts by weight of vinyl chloride-vinyl acetate copolymer (VMCH, manufactured by Union Carbide Corporation) and 200 parts by weight of n-butyl acetate is dispersed by a sand mill using glass beads having a diameter of 1 mm for 2 hours. The obtained dispersion liquid is coated on the underlying layer by an immersion method and the coated film is dried at 100° C. for ten minutes by the hot air drier, thereby forming a charge generation layer of a thickness of 0.2 μm.

Next, 45 parts by weight of N,N'-diphenyl-N,N'-bis(3-methylphenyl)-[1,1']biphenyl-4,4'-diamine and 55 parts by weight of bisphenol Z polycarbonate resin (molecular weight: 40,000) are added to 800 parts by weight of chlorobenzene and dissolved to obtain a coating liquid for a charge transporting layer. The coating liquid for the charge transporting layer is coated on the charge generation layer by an immersion method. The coated film is dried at 130° C. for 45 minutes by hot air drying, thereby forming a charge transporting layer having a thickness of 22 μm.

Next, 3.5 parts by weight of a compound represented by the following Structural formula I, 3 parts by weight of phenol resin (trade name: RESITOP PL-4852, manufactured by Gunei Chemical Industry Co., Ltd.), 0.5 parts by weight of polyvinyl phenol resin (manufactured by AldriCh), 0.015 parts by weight of modified silicone (trade name: GLANOL 100, manufactured by Kyoeisha Chemical Co., Ltd.) as a material for adjusting the contact angle between the surface of the image holding member and water to at least 70 degrees, 10 parts by weight of isopropyl alcohol and 0.2 parts by weight of 3,5-di-t-butyl-4-hydroxytoluene (BHT) are added to prepare a coating liquid for a protective layer.

The coating liquid for the protective layer is coated on the charge transporting layer by an immersion method, dried at a room temperature for 30 minutes, heated at 150° C. for one hour, and cured, thereby forming the protective layer having a thickness of about 4.0 μm. The image holding member A used in the following Example 1 is thus prepared.

Structural formula I

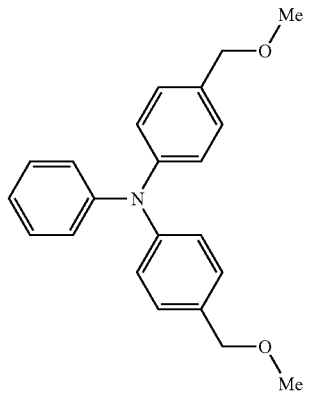

Preparation of Image Holding Member B

An underlying layer and a charge generation layer of an image holding member B is manufactured in the same manner as those of the image holding member A.

Next, 2 parts by weight of a charge transport compound expressed by the following Structural formula II and 3 parts by weight of bisphenol Z polycarbonate resin (molecular weight: 40000) are added and dissolved to 20 parts by weight of chlorobenzene to obtain a coating liquid for a charge transporting layer. The coating liquid for the charge transporting layer is coated on the charge generation layer by an immersion method, the coated film is dried at 110° C. for 40 minutes by hot air drying, thereby forming a charge transporting layer having a thickness of 22 μm.

Structural formula II

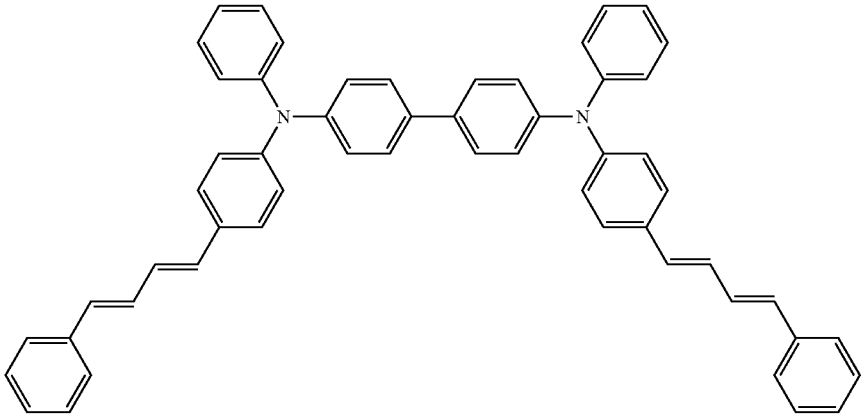

Next, the following components are dissolved in a mixture containing 10 parts by weight of isopropyl alcohol, 3 parts by weight of tetrahydrofuran, and 0.3 parts by weight of distillated water and 0.5 parts by weight of ion-exchanged resin (AMBERLYST®15E, manufactured by Rohm and Haas Company) is added and agitated at a room temperature, thereby performing hydrolysis for 24 hours.

| Components | |
|---|---|
| Structural formula III compound | 2 parts by weight |
| Methyl trimethoxysilane | 2 parts by weight |
| Tetra metoxysilane | 0.3 parts by weight |
| Colloidal silica | 0.1 parts by weight |
| Fluorine graft polymer (trade name: ZX007C, manufactured by Fuji Kasei Kogyo Co., Ltd.) | 0.5 parts by weight |

0.1 parts by weight of aluminum trisacetylacetonato (Al (aqaq)3) and 0.4 parts by weight of 3,5-di-t-butyl-4-hydroxytoluene (BHT) are added to the liquid obtained by removing the ion-exchanged resin from the hydrolyzed material by filtering so as to prepare a coating liquid for a protective layer.

Siloxane resin configured by crosslinking of methyl trimethoxysilane and tetramethoxysilane functions as a material for adjusting the contact angle between the surface layer and water.

The coating liquid for the protective layer is coated on the charge transporting layer by a ring type immersion method, dried at a room temperature for 30 minutes, heated at 170° C. for one hour, and cured, so as to form a protective layer having a thickness of about 4.0 μm. The image holding member B used in the following Example 2 is thus prepared.

Structural formula III

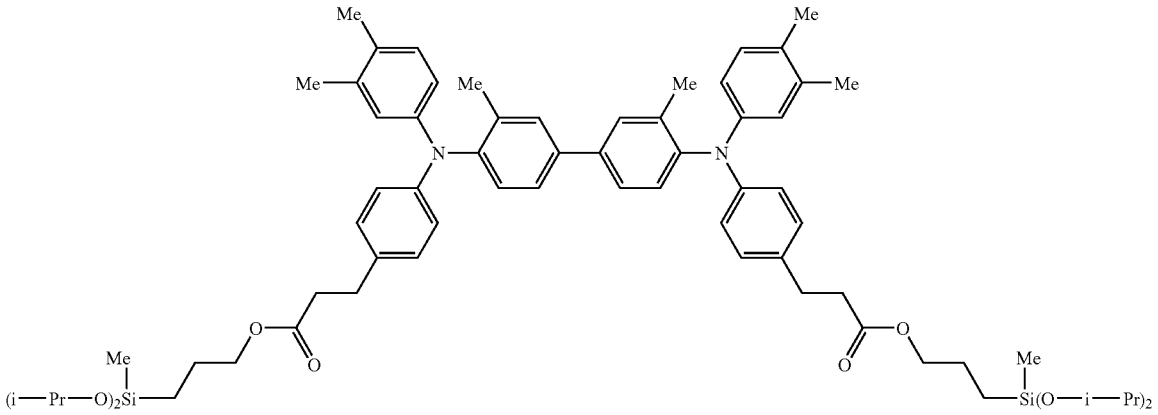

Preparation of Image Holding Member C

An underlying layer, a charge generation layer and a charge transporting layer of an image holding member C(, which is used in the following Comparative example 1,) is manufactured in the same manner as those of the image holding member A.

Preparation of Image Holding Member D

Firstly, an underlying layer and a charge generation layer of an image holding member D(, which is used in the following Comparative example 2,) is manufactured in the same manner as those of the image holding member A.

Next, 45 parts by weight of N,N'-diphenyl-N,N'-bis(3-methylphenyl)-[1,1']biphenyl-4,4'-diamine and 55 parts by weight of bisphenol Z polycarbonate resin (molecular weight: 40,000) are added to 800 parts by weight of chlorobenzene and dissolved to obtain a coating liquid for a charge transporting layer. The coating liquid for the charge transporting layer is coated on the charge generation layer by an immersion method. The coated film is dried at 130° C. for 45 minutes by the hot air drying, thereby forming a charge transporting layer having a thickness of 18 μm.

Further, 45 parts by weight of N,N'-diphenyl-N,N'-bis(3-methylphenyl)-[1,1']biphenyl-4,4'-diamine, 55 parts by weight of bisphenol Z polycarbonate resin (molecular weight: 40,000) and 14 parts by weight of alumina fine particles (trade name: AA-03, manufactured by Sumitomo Chemical Co., Ltd.) are added to 800 parts by weight of chlorobenzene and dissolved to obtain a coating liquid for a protective layer. The coating liquid for the protective layer is coated on the charge transporting layer by a spray method. The coated film is dried at 130° C. for 45 minutes by hot air drying, thereby forming a protective layer having a thickness of 6 μm. The image holding member D used in the following Comparative example 2 is thus prepared.

Preparation of Cleaning Blade

Cleaning Blade A

As polyol components, a hard segment material including polycaprolactone polyol (trade name: PLACCEL 205, manufactured by Daicel Chemical Industries, Ltd., average molecular weight: 529, hydroxyl value: 212 mgKOH/g) and another polycaprolactone polyol (trade name: PLACCEL 240, manufactured by Daicel Chemical Industries, Ltd., average molecular weight: 4155, hydroxyl value: 27 mgKOH/g) and a soft segment material including polybutadiene resin containing at least two hydroxyl groups (trade name: R-45HT, manufactured by Nippon Polyurethane Industry Co., Ltd.) are used. The hard segment material and the soft segment material are mixed with a ratio of 8:2.

Next, 6.26 parts by mass of 4,4'-diphenyl methane diisocyanate (trade name: MILLIONATE MT, manufactured by Nihon Polyurethane Industry Co., Ltd.) (hereinafter, referred to as "MDI") is added to 100 parts by mass of the mixture of the hard segment material and the soft segment material to be reacted at 70° C. for three hours in a nitrogen atmosphere.

The amount of the isocyanate compound used in this reaction is selected such that a ratio of an isocyanate group to a hydroxyl group (isocyanate group/hydroxyl group) included in a reaction system becomes 0.5.

Subsequently, 34.3 parts by mass of an isocyanate compound is further added and reacted at 70° C. for three hours in a nitrogen atmosphere so as to obtain a prepolymer.

The total amount of the isocyanate compound used in preparation of the prepolymer is 40.56 parts by mass.

Next, a temperature of the prepolymer is raised to 100° C., and defoaming is conducted under a reduced pressure for one hour. A mixture of 1,4-butadiol and trimethylolpropane (mass ratio of 1,4-butadiol/trimethylolpropane=60/40) is added to the resultant so that 7.14 parts by mass of the mixture is added relative to 100 parts by mass of the prepolymer. Further, the prepolymer and the mixture are sufficiently mixed for 3 minutes in such a manner that foam is not generated. The resultant is then cured in a centrifugal molding machine having an adjusted mold at 140° C. for one hour, thereby obtaining a flat plate. The flat plate is crosslinked at 110° C. for 24 hours and cooled. Further, the flat plate is cut to a predetermined size, thereby obtaining a cleaning blade A having a thickness of 2 mm.

Cleaning Blade B

A cleaning blade B is prepared in the same manner as the cleaning blade A, except that a mixture of a hard segment material and a soft segment material is prepared as follows.

Namely, the hard segment material for the cleaning blade B is the same as that used in the cleaning blade A. The soft segment material for the cleaning blade B is an epoxy resin containing at least two hydroxyl groups (trade name: EPICLON EXA-4850-150, manufactured by Dainippon Ink and Chemicals Inc.). The hard segment material and the soft segment material are mixed with a ratio of 8:2 to form the mixture used in the preparation of the cleaning blade B.

Cleaning Blade C

A cleaning blade C is obtained using the same method as that of the cleaning blade A except that, instead of the mixture of the hard segment material and the soft segment material, only a polyol component COLLONATE 4086 (trade name, manufactured by Nihon Polyurethane Industry Co., Ltd.) is used, and 6.8 parts by mass of NIPPOLAN 4038 (trade name, manufactured by Nihon Polyurethane Industry Co., Ltd.) is used as the isocyanate compound relative to 100 parts by weight of the COLLONATE 4086 (described above).

Cleaning Blade D

A cleaning blade D is obtained using the same method as that of the cleaning blade A except that, instead of the mixture of the hard segment material and the soft segment material, only a polyol component COLLONATE 4370 (trade name, manufactured by Nihon Polyurethane Industry Co., Ltd.) is used, and 75 parts by mass of NIPPOLAN 4379 (trade name, manufactured by Nihon Polyurethane Industry Co., Ltd.) is used as the isocyanate compound relative to 100 parts by weight of the COLLONATE 4370 (described above).

Cleaning Blade E

A cleaning blade D is obtained using the same method as that of the cleaning blade A except that, instead of the mixture of the hard segment material and the soft segment material, only a polyol component COLLONATE 4370 (trade name, manufactured by Nihon Polyurethane Industry Co., Ltd.) is used, and 85 parts by mass of NIPPOLAN 4379 (trade name, manufactured by Nihon Polyurethane Industry Co., Ltd.) is used as the isocyanate compound relative to 100 parts by weight of the COLLONATE 4370 (described above).

Example 1, Example 2, Comparative Example 1, and Comparative Example 2

The thus prepared image-bearing bodies A to D are mounted as the image holding member 70 in the apparatus shown in FIG. 4 and left for eight hours in an environment of a temperature of 22° C. and a humidity of 55% RH, and the contact angles between each of the image-bearing bodies A to D and pure water is measured as a contact angle for pure water in an initial state.

Next, in the apparatus shown in FIG. 4 in which the image-bearing bodies A to D are mounted, in an environment having a temperature of 22° C. and a humidity of 55% RH, a state where a sine-wave alternating bias of a peak-to-peak voltage having 1.5 KV and 1320 Hz is applied to the charging roll 72 by the voltage applying mechanism 74 and a process speed as a rotation speed (movement speed of the outer circumferential surface) of the image holding member 70 is 165 m/s as the discharge stress condition is continued for 114.2 seconds, and then the contact angle between the image holding member and pure water is measured as a contact angle for pure water after the discharge stress.

The circumferential length of each of the manufactured image-bearing bodies A to D is 94.2 mm and the diameter of the used charging roll 72 is 14 mm, and volume resistance (Ω·m) is LogR=7.6.

The contact angle for pure water is measured under the condition of a temperature of 22° C. and a humidity of 55% RH by dropping pure liquid droplet having a diameter of about 1.5 mm on the surface of the image holding member 70 and measuring the contact angle (see FIG. 3) of the droplet after 10 seconds using a contact angle meter device (trade name: CA-S ROLL, manufactured by Kyowa Kaimen KK).

An average value of three measurement values, which are obtained by performing measurement three times while changing a measurement place, is evaluated as the contact angle between the surface of the image holding member and pure water.

The image-bearing bodies A to D are mounted to a printer (trade name: DOCUPRINT C3530, manufactured by Fuji Xerox Printing Systems Co., Ltd.). Further, a character chart having a printing ratio of 5% is printed on 10,000 sheets of paper of A4 size using the toner A. The printed paper sheets are left for 24 hours in an environment of a temperature of 28° C. and a humidity of 80%. Further, a halftone image having a concentration of 30% is output on the entire surface of the A3-sized sheets. The resulted outputs are observed by naked eyes. In a case where a uniform halftone image is obtained, it is evaluated that image deletion does not occur. In a case where image deletion corresponding to the character chart occurs, it is evaluated that the image deletion occurs.

The sine-wave alternating current bias of the peak-to-peak voltage having 1.5KV and 1320 Hz is applied to the charging roll 36, and similar to above, the process speed as the movement speed of the outer circumferential surface of the image holding member 13 is 165 m/s.

The sample which uses the image holding member A is named as Example 1, the sample which uses the image holding member B is named as Example 2, the sample which uses the image holding member C is named as Comparative example 1, and the sample which uses the image holding member D is named as Comparative example 2.

Results of measurements of the contact angle for pure water in the initial state and the contact angle for pure water after the discharge stress, which are measured in the image holding member A of Example 1, the image holding member B of Example 2, the image holding member C of Comparative example 1 and the image holding member D of Comparative example 2 are shown in Table 1. Evaluation results of the image deletion are also shown in Table 1.

TABLE 1

| | Kind of image holding member | Contact angle for pure water in initial state (degree) | Contact angle for pure water after discharge stress (degree) | Image deletion |
|---|---|---|---|---|
| Example 1 | Image holding member A | 98 | 87 | Not occur |
| Example 2 | Image holding member B | 95 | 75 | Not occur |
| Comparative Example 1 | Image holding member C | 93 | 50 | Occurs |
| Comparative Example 2 | Image holding member D | 92 | 62 | Occurs |

As shown in Table 1, in Examples 1 and 2, in which the image holding member A or the image holding member B having the contact angle for pure angle after the discharge stress is applied of at least 70% is mounted in the printer (DOCUPRINT C3530: described above), the image deletion does not occur. However, in Comparative examples 1 and 2, in which the image holding member A or the image holding member B having the contact angle for pure angle after the discharge stress is applied of less than 70% is mounted in the printer (DOCUPRINT C3530: described above), the image deletion occurs.

From the results shown in Table 1, it is understood that it is possible to suppress the image deletion from occurring in an image forming apparatus having an image holding member of which the contact angle between the image holding member and pure angle is at least 70% in an environment having 22° C. and 55% RH after applying the discharge stress in which a state where a sine-wave alternating bias of a peak-to-peak voltage having 1.5 KV and 1320 Hz is applied to the charging roll and a process speed is 165 m/s is continued for 114.2 seconds.

Examples 3 to 7

Next, evaluations for Examples 3 to 7 are conducted by using the toner A. In each of the evaluations, the image holding member B is attached to DOCUPRINT C3530 (described above) as a photosensitive body, and the manufactured cleaning blades A to E are respectively mounted as shown in Table 2 instead of the cleaning blade provided in this printer.

The sample in which the cleaning blade A is mounted on the printer (DOCUPRINT C3530, described above) is named as Example 3, the sample in which the cleaning blade B is mounted on the printer is named as Example 4, and the sample in which the cleaning blade C is mounted on the printer is named as Example 5. The sample in which the cleaning blade D is mounted on the printer is named as Example 6, and the sample in which the cleaning blade E is mounted on the printer is named as Example 7.

The components, 100% modulus, α and results of measuring of breaking extension of the cleaning blades A to E are shown in Table 2.

TABLE 2

| | | Hard segment material (H) | Soft segment material (S) | Hard segment material ratio [H/(S + H)] (wt %) | 100% modulus (MPa) | α [Δstress/Δdistortion] (MPa/%) | Breaking extension (%) |
|---|---|---|---|---|---|---|---|
| Example 3 | Cleaning blade A | Polycaprolactone polyol | Polybutadiene resin | 80 | 7.4 | 0.039 | 535 |
| Example 4 | Cleaning blade B | Polycaprolactone polyol | Epoxy resin | 80 | 11.3 | 0.059 | 380 |
| Example 5 | Cleaning blade C | Polyol component (collonate 4086) | | — | 3.4 | 0.044 | 300 |
| Example 6 | Cleaning blade D | Polyol component (collonate 4370) | | — | 11.8 | 0.324 | 200 |
| Example 7 | Cleaning blade E | Polyol component (collonate 4370) | | — | 33.3 | — (breaking) | 150 |

The image deletion and cleaning failure are evaluated for the printers of Examples 3 to 7, each of which has the cleaning blades A to E respectively as shown in Table 2.

In the evaluation conditions, the sine-wave alternating bias of a peak-to-peak voltage having 1.5 KV and 1320 Hz is applied to the charging roll, the process speed is 165 m/s, and the environment of the evaluation is 22° C. and 55% RH.

The evaluation results are shown in Table 3.

In the evaluation of the image deletion shown in Table 3, a character chart having a printing ratio of 5% is printed on 10,000 sheets of A4-sized recording paper in an environment having a high temperature and a high humidity (28° C. and 80% RH) and left for 24 hours in the environment having the high temperature and the high humidity (28° C. and 80% RH). The output results obtained by outputting a halftone image having a concentration of 30% on the entire surface of the recording medium are observed by naked eyes. In a case where a uniform halftone image is obtained, it is evaluated that image deletion does not occur. In a case where image deletion corresponding to the character chart occurs, it is evaluated that the image deletion occurs.

The evaluation of the cleaning failure shown in Table 3 is conducted after the evaluation of the image deletion. The printers of Examples 3 to 7 are used to print a character chart having a printing ratio of 5% on 50,000 sheets of A4-sized recording paper in an environment having a high temperature and a high humidity (28° C. and 80% RH). The output results obtained by outputting a halftone image having a concentration of 30% on the entire surface of the recording medium are observed. In a case where a uniform halftone image is obtained, it is evaluated that cleaning failure does not occur. In a case where a stain having a stripe shape is observed, it is evaluated that the cleaning failure occurs.

TABLE 3

| | IMAGE DELETION | CLEANING FAILURE |
|---|---|---|
| Example 3 | Not occur | not occur |
| Example 4 | Not occur | not occur |
| Example 5 | Not occur | Occurs |
| Example 6 | Not occur | Occurs |
| Example 7 | Not occur | Occurs |

As can be seen from Examples 3 to 7 in Table 3, the image deletion does not occur in all the cases of using the cleaning blades A to E. It is expected that the reason of the results in Examples 3 to 7 is that the image holding member B, the contact angle for pure water after applying the discharge stress of which is at least 70%, is used in Examples 3 to 7.

As shown in Table 3, while the cleaning failure does not occur in Example 3 and Example 4, the cleaning failure occurs in Examples 5 to 7. According to the results, it would be concluded that the cleaning blade in which the material of a portion which faces the surface of the image holding member satisfies the Inequalities (1) to (3), such as the cleaning blade A or the cleaning blade B, is superior in suppressing the cleaning failure, compared with the cleaning blades C to E (Examples 5 to 7) in which the material does not the Inequalities (1) to (3).

Examples 8 to 15

Next, evaluations for Examples 8 to 15 are conducted by using the toner A. In each of the evaluations, the image holding member A and the cleaning blade A are attached to DOCUPRINT C3530 (described above), and the relationship between the movement speed Sp of the image holding member and the movement speed Sb of the intermediate transfer belt is set to values shown in Table 4.

The sample in which Sb/Sp is 1.000 is named as Example 8. The sample in which Sb/Sp is 1.005 is Example 9. The sample in which Sb/Sp is 1.010 is named as Example 10. Further, The sample in which Sb/Sp is 1.025 is named as Example 11. In addition, the sample in which Sb/Sp is 1.035 is named as Example 12. The sample in which Sb/Sp is 1.040 is named as Example 13. The sample in which Sb/Sp is 1.050 is named as Example 14. Further, the sample in which Sb/Sp is 1.060 is named as Example 15.

The sine-wave alternating-current bias of a peak-to-peak voltage having 1.5 KV and a frequency 1320 Hz is applied to the charging roll. The process speed of the image holding member is 165 m/s, as is similar to the above Examples. Further, the movement speed of the intermediate transfer belt is changed.

In each of the speed setting conditions of the Examples 8 to 15, the output process is performed in an environment having a high temperature and a high humidity (28° C. and 80% RH). Namely, a concentrated character chart having a printing ratio of 10% as shown in FIG. 5A is printed on 10,000 sheets of A4-sized recording paper 90, and then a halftone image having a concentration of 30% is further output on the entire surface of the recording paper 90.

With respect to the output results, the image deletion of a concentrated image portion and the image deletion of a background portion are evaluated.

The image deletion in the concentrated image portion is evaluated as follows. That is, a region corresponding to the concentrated image chart is referred as a "concentrated image portion" (see the concentrated image portion 92 of FIG. 5A). When it is observed that the concentration is reduced in a whole area of the processing direction corresponding to the concentrated image portion 92 (see a concentration reducing portion 96 of FIG. 5B), the image deletion is evaluated as it "occurs". When it is observed that the concentration is reduced in a portion of the processing direction corresponding to the concentrated image portion 92 (see a partially concentration reducing portion 98 of FIG. 5C), the image deletion is evaluated as it "slightly occurs". Further, when the concentration reduction is not observed in the processing direction corresponding to the concentrated image portion, the image deletion is evaluated to does "not occur".

Figure 5A:
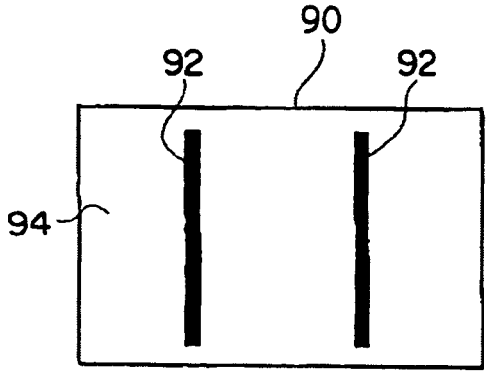
FIG. 5A is a schematic diagram showing an intensive image unit.
Figure 5B:
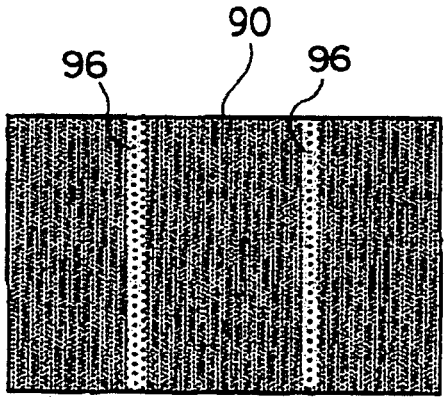
FIG. 5B is a schematic diagram showing a state where image deletion occurs.
Figure 5C:
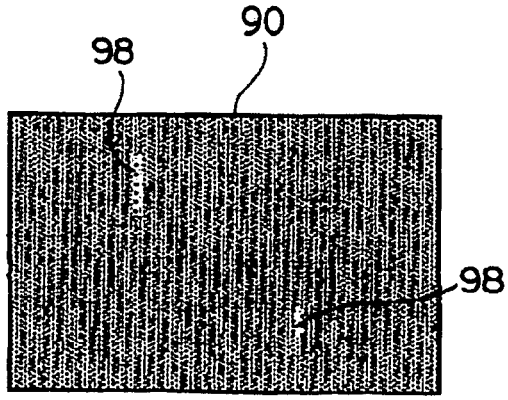
FIG. 5C is a schematic diagram showing a state where image deletion slightly occurs.

In the evaluation of the image deletion in the background portion, a region except the region corresponding to the concentrated image portion 92 of the concentrated image chart on the recording sheet 90 is referred as a "background portion" (see the concentrated image portion 92 and the background portion 94 of FIG. 5A). When it is observed that the concentration is reduced in the region corresponding to the whole background portion 94, the image deletion is evaluated as it "occurs". When it is observed that the concentration is reduced in a portion of the region corresponding to the concentrated image portion 92, the image deletion is evaluated as it "slightly occurs". Further, when the concentration reduction is not observed in the region corresponding to the concentrated image portion, the image deletion is evaluated as it does "not occur".

Further, the banding is evaluated with respect to the formation of the halftone image having a concentration of 30% and the formation of the halftone image having a concentration of 70% by observing non-uniformity in concentration having a stripe shape, that is what is called a banding occurrence, by naked eyes.

In the banding evaluation, when the banding is not observed in both the 30% halftone image and the 70% halftone image by visual observation, the banding is evaluated as it does "not occur". When the banding is observed in any one of the 30% halftone image and the 70% halftone image by visual observation banding is evaluated as it "slightly occurs". Further, when the banding is observed in both the 30% halftone image and the 70% halftone image by visual observation, the banding is evaluated as it "occurs".

TABLE 4

| | Sb/Sp | Image deletion of concentrated image portion | Image deletion of background portion | Banding |
|---|---|---|---|---|
| Example 8 | 1.000 | Occurs | Not occur | Not occur |
| Example 9 | 1.005 | Slightly occurs | Not occur | Not occur |
| Example 10 | 1.010 | Not occur | Not occur | Not occur |
| Example 11 | 1.025 | Not occur | Not occur | Not occur |
| Example 12 | 1.035 | Not occur | Not occur | Not occur |
| Example 13 | 1.040 | Not occur | Not occur | Slightly occurs |
| Example 14 | 1.050 | Not occur | Not occur | Slightly occurs |
| Example 15 | 1.060 | Not occur | Not occur | Significantly occurs |

As shown in Example 8 to Example 15 in Table 4, while the image deletion occurs in the concentrated image portion in Example 8, and the image deletion slightly occurs in the concentrated image portion in Example 9, the image deletion does not occur in the concentrated image portion in Examples 10 to 15. Further, the image deletion does not occur in both of the concentrated image portion and the background portion in Examples 10 to 15.

In Examples 8 to 12, the banding does not occur. In Examples 13 to 14, while the banding slightly occurs, it is not practically problematic. On the other hand, in Example 15, that has Sb/Sp which is larger than 1.05, the banding significantly occurs.

According to the results, it would be concluded that Examples 9 to 14, in which the speeds are adjusted such that Sb/Sp satisfy the Inequality (4). or the Inequality (5) is satisfied, can suppress the image deletion as well as the banding, compared with Examples 8 and 15, in which the Inequality (4) and (5) are not satisfied.

While the above exemplary embodiments are provided in this specification for the purposes of illustration, it should be understood that these are not intended to be exhaustive or to limit the present invention. Any modifications and variations can be allowed and included in the scope of the present invention as long as the modifications and variations do not affect the primary configuration of the present invention.

What is claimed is:

1. An image holding member comprising a surface that has, after a predetermined discharge stress that is conditioned so that a sine-wave alternating-current bias of a peak-to-peak bias having 1.5 KV and a frequency 8 time S (Hz) is applied to the surface of the image holding member that is in a driving state where the movement speed of the surface is S (mm/s) is applied, a contact angle of water of at least about 70 degrees at a temperature of 22° C. and a relative humidity (RH) of 55%.

2. The image holding member according to claim 1, wherein the surface thereof comprises a resin comprising a crosslinked structure.

3. An image forming apparatus comprising:

an image holding member, comprising a surface that has, after a predetermined discharge stress that is conditioned so that a sine-wave alternating-current bias of a peak-to-peak bias having 1.5 KV and a frequency 8 time S (Hz) is applied to the surface of the image holding member that is in a driving state where the movement speed of the surface is S (mm/s) is applied, a contact angle of water of at least 70 degrees at a temperature of 22° C. and a relative humidity (RH) of 55%, the image holding member rotating in a predetermined direction;

a charging device that charges a surface of the image holding member by electric discharge;

a latent image forming device that forms an electrostatic latent image that corresponds to image data on the surface of the image holding member charged by the charging device;

a developing device which develops the electrostatic latent image by a developer containing a toner to form a toner image; and a transfer device which transfers the toner image on the image holding member onto a member to be transferred onto which moves at a movement speed different from that of the surface of the image holding member in a region which faces the image holding member.

4. The image forming apparatus according to claim 3, wherein the surface of the image holding member comprises a resin comprising a crosslinked structure.

5. The image forming apparatus according to claim 3, wherein the developer contains any one or both of an abrasive and a lubricant.

6. The image forming apparatus according to claim 3, further comprising a cleaning device which is formed at a downstream side in a rotation direction of the image holding member to a position where the toner image formed on the image holding member is transferred onto the member to be transferred onto, for removing adhered material on the image holding member.

7. The image forming apparatus according to claim 6, wherein the surface of the image holding member comprises a resin comprising a crosslinked structure.

8. The image forming apparatus according to claim 6, wherein the developer contains any one or both of an abrasive and a lubricant.

9. The image forming apparatus according to claim 6, wherein the cleaning device is brought into contact with the surface of the image holding member, and the material of at least the portion of the cleaning device to be brought into contact with the image holding member satisfies the following inequalities (1) to (3):

$$3.92 \leqq M \leqq 29.42; \quad \text{Inequality (1)}$$

$$0 < \alpha \leqq 0.294; \text{ and} \quad \text{Inequality (2)}$$

$$S \geqq 250 \quad \text{Inequality (3)}$$

wherein M denotes 100% modulus (MPa); α denotes the ratio {Δstress/Δstrain degree=(stress at 200% strain degree−stress at 100% strain degree)/(200−100)} (MPa/%) of the change in stress (Δstress) to the change in strain (Δstrain) in a range of 100% to 200% strain degree in the stress-strain curve; and S denotes the breaking elongation (%) measured according to ISO 37:2005 (using a dumbbell-type No. 3 test piece).

10. The image forming apparatus according to claim 9, wherein the surface of the image holding member comprises a resin comprising a crosslinked structure.

11. The image forming apparatus according to claim 9, wherein the developer contains any one or both of an abrasive and a lubricant.

12. The image forming apparatus according to claim 9, wherein the material is an elastomer material including a hard segment and a soft segment, and wherein a weight ratio of the material for configuring the hard segment is in a range of about 46 to 96% by weight, with respect to the total amount of material for configuring the hard segment and material for configuring the soft segment.

13. The image forming apparatus according to claim 12, wherein the surface of the image holding member comprises a resin comprising a crosslinked structure.

14. The image forming apparatus according to claim 12, wherein the developer contains any one or both of an abrasive and a lubricant.

15. The image forming apparatus according to claim 3, wherein the transfer device comprises a first transfer device that transfers the toner image on the image holding member onto an intermediate transfer body as the member to be transferred onto and a second transfer device which transfers the toner image transferred onto the intermediate transfer body onto a recording medium as the transferred member, and wherein, in a region in which the image holding member and the intermediate transfer body face each other, the relationship between a movement speed Sp of the image holding member and a movement speed Sb of the intermediate transfer body satisfies the following inequality (4) or inequality (5):

$$1.01 \leqq Sb/Sp \leqq 1.05 \qquad \text{Inequality (4)}$$

$$1.01 \leqq Sp/Sb \leqq 1.05. \qquad \text{Inequality (5)}$$

16. The image forming apparatus according to claim 15, further comprising a cleaning device which is formed at a downstream side in a rotation direction of the image holding member to a position where the toner image formed on the image holding member is transferred onto the member to be transferred onto, for removing adhering material on the image holding member.

17. The image forming apparatus according to claim 16, wherein the surface of the image holding member comprises a resin comprising a crosslinked structure.

18. The image forming apparatus according to claim 16, wherein the developer contains any one or both of an abrasive and a lubricant.

19. The image forming apparatus according to claim 16, wherein the cleaning device is brought into contact with the surface of the image holding member, and the material of at least the portion of the cleaning device to be brought into contact with the image holding member satisfies the following inequalities (1) to (3):

$$3.92 \leqq M \leqq 29.42; \qquad \text{Inequality (1)}$$

$$0 < \alpha \leqq 0.294; \text{ and} \qquad \text{Inequality (2)}$$

$$S \geqq 250 \qquad \text{Inequality (3)}$$

wherein M denotes 100% modulus (MPa); α denotes the ratio {Δstress/Δstrain degree=(stress at 200% strain degree−stress at 100% strain degree)/(200−100)} (MPa/%) of the change of stress (Δstress) to the change of strain (Δstrain) in a range of 100% to 200% strain degree in the stress-strain curve; and S denotes the breaking elongation (%) measured according to ISO 37:2005 (using a dumbbell-type No. 3 test piece).

* * * * *